US009658544B2

(12) United States Patent
Katsuhara et al.

(10) Patent No.: US 9,658,544 B2
(45) Date of Patent: May 23, 2017

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Hideya Katsuhara, Kanagawa (JP); Takashi Imai, Kanagawa (JP); Takeshi Iwanaga, Kanagawa (JP); Masaki Hirakata, Kanagawa (JP); Tatsuki Sano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/048,363

(22) Filed: Feb. 19, 2016

(65) Prior Publication Data

US 2017/0090310 A1 Mar. 30, 2017

(30) Foreign Application Priority Data

Sep. 25, 2015 (JP) ..... 2015-188325

(51) Int. Cl.
*G03G 5/05* (2006.01)
*G03G 5/147* (2006.01)
(Continued)

(52) U.S. Cl.
CPC ..... *G03G 5/0564* (2013.01); *G03G 5/0433* (2013.01); *G03G 5/0507* (2013.01); *G03G 5/087* (2013.01); *G03G 5/14704* (2013.01)

(58) Field of Classification Search
CPC . G03G 5/0507; G03G 5/14704; G03G 5/0564
See application file for complete search history.

(56) References Cited

U.S. PATENT DOCUMENTS 6,326,111 B1 * 12/2001 Chambers ..... G03G 5/05 399/176
8,404,415 B2 * 3/2013 Iwanaga ..... G03G 5/14704 399/111
(Continued)

FOREIGN PATENT DOCUMENTS

JP 07295250 A * 11/1995
JP 2002287387 A * 10/2002
(Continued)

OTHER PUBLICATIONS

English language machine translation of JP 07-295250 (Nov. 1995).*
(Continued)

*Primary Examiner* — Christopher Rodee
(74) *Attorney, Agent, or Firm* — Oliff PLC

(57) ABSTRACT

An electrophotographic photoreceptor includes an electroconductive substrate, a photosensitive layer provided on the electroconductive substrate, and an inorganic surface layer provided on the photosensitive layer, wherein a layer constituting an outermost surface of the photosensitive layer contains from 30% by weight to 70% by weight of silica particles and contains a biphenyl copolymerization type polycarbonate resin including a structural unit represented by the formula (PCA) and a structural unit represented by the formula (PCB) at a copolymerization ratio (PCA:PCB (molar ratio)) of 10:90 to 50:50:
(Continued)

(PCA)

(PCB)

wherein, $R^{P1}$, $R^{P2}$, $R^{P3}$, and $R^{P4}$ each represent a hydrogen atom, a halogen atom, an alkyl group having 1 to 6 carbon atoms, a cycloalkyl group having 5 to 7 carbon atoms, or an aryl group having 6 to 12 carbon atoms, and $X^{P1}$ represents a phenylene group, a biphenylene group, a naphthylene group, an alkylene group, or a cycloalkylene group.

6 Claims, 7 Drawing Sheets

(51) Int. Cl.
*G03G 5/043* (2006.01)
*G03G 5/087* (2006.01)

(56) References Cited

U.S. PATENT DOCUMENTS

2002/0115005 A1* 8/2002 Ikuno ..... G03G 5/0507 430/66
2003/0129512 A1* 7/2003 Sugino ..... G03G 5/0503 430/66
2005/0106489 A1 5/2005 Sugahara et al.
2005/0277036 A1* 12/2005 Dinh ..... G03G 5/14704 430/66
2006/0029803 A1* 2/2006 Qi ..... G03G 5/0507 428/403
2006/0115761 A1* 6/2006 Itami ..... G03G 5/0507 430/122.1
2006/0134537 A1* 6/2006 Black ..... G03G 5/0507 430/58.2
2006/0216621 A1* 9/2006 Yamane ..... G03G 5/047 430/59.6
2008/0026313 A1 1/2008 Sugahara et al.
2008/0260427 A1* 10/2008 Iwanaga ..... G03G 5/14704 399/159
2009/0253061 A1* 10/2009 Yagi ..... G03G 5/0436 430/58.65
2011/0229810 A1* 9/2011 Katsuhara ..... G03G 5/085 430/56
2013/0337373 A1* 12/2013 Hirata ..... C08G 63/64 430/96
2014/0011128 A1* 1/2014 Morishita ..... G03G 5/0564 430/56
2014/0072906 A1* 3/2014 Iwadate ..... G03G 5/0514 430/56
2014/0295334 A1* 10/2014 Hirakata ..... G03G 5/0436 430/56
2015/0010859 A1* 1/2015 Hirata ..... G03G 5/0564 430/70
2015/0253682 A1* 9/2015 Azuma ..... G03G 5/047 430/58.25
2015/0261105 A1* 9/2015 Wu ..... G03G 5/0564 428/412

FOREIGN PATENT DOCUMENTS

JP 2003-186227 A 7/2003
JP 2005-173566 A 6/2005
JP 2006010921 A * 1/2006
JP 2007295250 A * 11/2007
JP 2011227301 A * 11/2011
JP 2013029590 A * 2/2013
JP 2015025912 A * 2/2015

OTHER PUBLICATIONS

English language machine translation of JP 2002-287387 (Oct. 2002).*
ISO 179-1 "Plastics—Determination of Charpy impact properties" (2010) 29 pages.*

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-188325 filed Sep. 25, 2015.

BACKGROUND

1. Technical Field

The present invention relates to an electrophotographic photoreceptor, a process cartridge, and an image forming apparatus.

2. Related Art

In the related art, an apparatus which subsequently performs steps of performing charging, electrostatic latent image forming, developing, transferring, and cleaning using an electrophotographic photoreceptor has been widely known as an electrophotographic image forming apparatus.

A function separation type photoreceptor in which a charge generation layer which generates a charge and a charge transport layer which transports a charge are laminated on an electroconductive substrate or a single layer type photoreceptor having one layer which realizes a function of generating a charge and a function of transporting a charge has been known as the electrophotographic photoreceptor.

SUMMARY

According to an aspect of the invention, there is provided an electrophotographic photoreceptor including:

an electroconductive substrate;

a photosensitive layer provided on the electroconductive substrate; and an inorganic surface layer provided on the photosensitive layer, wherein a layer constituting an outermost surface of the photosensitive layer contains from 30% by weight to 70% by weight of silica particles and contains a biphenyl copolymerization type polycarbonate resin including a structural unit represented by the formula (PCA) and a structural unit represented by the formula (PCB) at a copolymerization ratio (PCA:PCB (molar ratio)) of 10:90 to 50:50:

(PCA)

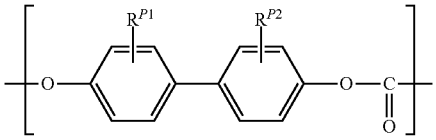

(PCB)

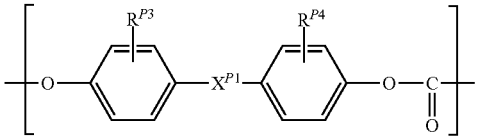

wherein, $R^{P1}$, $R^{P2}$, $R^{P3}$, and $R^{P4}$ each independently represent a hydrogen atom, a halogen atom, an alkyl group having 1 to 6 carbon atoms, a cycloalkyl group having 5 to 7 carbon atoms, or an aryl group having 6 to 12 carbon atoms, and $X^{P1}$ represents a phenylene group, a biphenylene group, a naphthylene group, an alkylene group, or a cycloalkylene group.

BRIEF DESCRIPTION OF THE DRAWINGS

Exemplary embodiments of the present invention will be described in detail based on the following figures, wherein.

DETAILED DESCRIPTION

Figure 1:
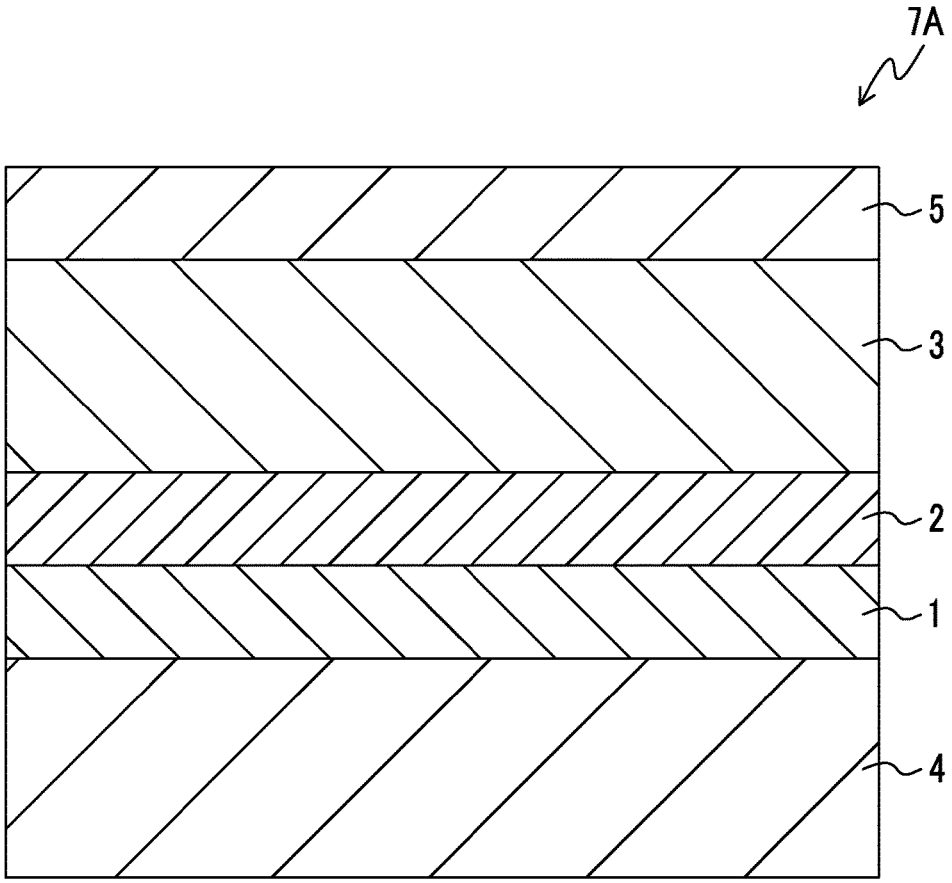
FIG. 1 is a sectional view schematically showing an example of a layer configuration of an electrophotographic photoreceptor of the exemplary embodiment.

Hereinafter, the exemplary embodiments of the invention will be described in detail.

Electrophotographic Photoreceptor

First Embodiment

An electrophotographic photoreceptor according to a first embodiment includes an electroconductive substrate, a photosensitive layer provided on the electroconductive substrate, and an inorganic surface layer provided on the photosensitive layer.

A layer (hereinafter, also simply referred to as an "outermost surface layer") constituting an outermost surface of the photosensitive layer contains from 30% by weight to 70% by weight of silica particles. The outermost surface of the photosensitive layer contains a biphenyl copolymerization type polycarbonate resin including a structural unit represented by the formula (PCA) and a structural unit represented by the formula (PCB) at a copolymerization ratio (PCA:PCB (molar ratio)) of 10:90 to 50:50.

(PCA)

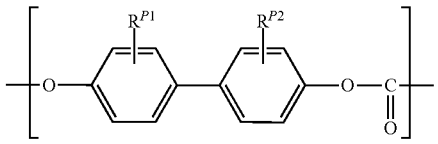

-continued (PCB)

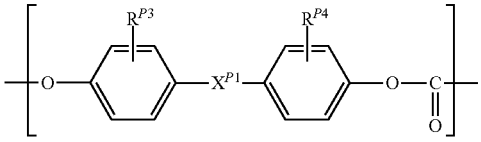

(In the formula (PCA) and the formula (PCB), $R^{P1}$, $R^{P2}$, $R^{P3}$, and $R^{P4}$ each independently represent a hydrogen atom, a halogen atom, an alkyl group having 1 to 6 carbon atoms, a cycloalkyl group having 5 to 7 carbon atoms, or an aryl group having 6 to 12 carbon atoms. $X^{P1}$ represents a phenylene group, a biphenylene group, a naphthylene group, an alkylene group, or a cycloalkylene group.)

In an electrophotographic photoreceptor (hereinafter, also simply referred to as a "photoreceptor") including an organic photosensitive layer and an inorganic surface layer on an electroconductive substrate, silica particles are contained in an outermost surface layer of the organic photosensitive layer as a reinforcing material, in order to prevent deformation of the outermost surface layer of the organic photosensitive layer to reduce cracks on the inorganic surface layer. However, in a case where a large amount of silica particles which is 30% by weight or more is added with respect to the outermost surface layer of the organic photosensitive layer, cracks may be formed on the inorganic surface layer and the outermost surface layer of the inorganic photosensitive layer. As a result, a phenomenon of decreasing image density when continuously forming images (image blurring) occurs due to the formation of cracks.

With respect to this, the photoreceptor according to the first embodiment includes the photosensitive layer and the inorganic surface layer on the electroconductive substrate, in which the outermost surface layer of the photosensitive layer contains from 30% by weight to 70% by weight of silica particles, and the outermost surface layer of the photosensitive layer contains the biphenyl copolymerization type polycarbonate resin including the structural unit represented by the formula (PCA) and the structural unit represented by the formula (PCB) at the copolymerization ratio (PCA:PCB (molar ratio)) described above, and therefore, formation of cracks on the inorganic surface layer and the outermost surface layer of the photosensitive layer is prevented.

The reason for exhibiting this effect is not clear but it is assumed as follows.

An impact may be applied to the outermost surface of the photoreceptor due to a collision of carriers in a developer or the like. In a case where the outermost surface layer of the photosensitive layer contains a large amount of silica particles which is 30% by weight or more, this impact is also transmitted to the outermost surface layer of the photosensitive layer through the inorganic surface layer, and further transmitted to an interface between the silica particles, a large amount of which is contained in the outermost surface layer, and a binder resin, to form cracks on the interface and to also form cracks in the binder resin which is present between the silica particles, and as a result, cracks may be formed on the outermost surface layer of the photosensitive layer and the inorganic surface layer.

With respect to this, in the first embodiment, the biphenyl copolymerization type polycarbonate resin satisfying the requirements described above is contained, and accordingly, even in a case where an impact is transmitted to the outermost surface layer of the photosensitive layer through the inorganic surface layer, the formation of cracks in the interface between the silica particles and the binder resin and formation of cracks in the binder resin which is present between the silica particles are prevented, and cracks on the outermost surface layer of the photosensitive layer and the inorganic surface layer may be prevented. As a result, formation of image blurring due to cracks may be prevented.

Second Embodiment

An electrophotographic photoreceptor according to a second embodiment includes an electroconductive substrate, a photosensitive layer provided on the electroconductive substrate, and an inorganic surface layer provided on the photosensitive layer.

An outermost surface layer of the photosensitive layer contains from 30% by weight to 70% by weight of silica particles. In addition, charpy impact strength of the outermost surface layer of the photosensitive layer is from 12 $kJ/m^2$ to 35 $kJ/m^2$.

In the photoreceptor including the photosensitive layer and the inorganic surface layer on the electroconductive substrate, in a case where the outermost surface layer of the photosensitive layer contains a large amount of silica particles which is 30% by weight or more is added to the outermost surface layer of the photosensitive layer, cracks may also be formed on the inorganic surface layer and the outermost surface layer of the photosensitive layer, and as a result, image blurring may occur due to the cracks.

With respect to this, the photoreceptor according to the second embodiment includes the photosensitive layer and the inorganic surface layer on the electroconductive substrate, in which the outermost surface layer of the photosensitive layer contains from 30% by weight to 70% by weight of silica particles, and the charpy impact strength of the outermost surface layer of the photosensitive layer is from 12 $kJ/m^2$ to 35 $kJ/m^2$, and therefore, formation of cracks on the inorganic surface layer and the outermost surface layer of the photosensitive layer is prevented.

The reason for exhibiting this effect is not clear but it is assumed as follows.

An impact may be applied to the outermost surface of the photoreceptor due to a collision of carriers in a developer or the like. In a case where the outermost surface layer of the photosensitive layer contains a large amount of silica particles which is 30% by weight or more, this impact is also transmitted to the outermost surface layer of the photosensitive layer through the inorganic surface layer, and further transmitted to an interface between the silica particles, a large amount of which is contained in the outermost surface layer, and a binder resin, to form cracks on the interface and to also form cracks in the binder resin which is present between the silica particles, and as a result, cracks may be formed on the outermost surface layer of the photosensitive layer and the inorganic surface layer.

In the second embodiment, the charpy impact strength of the outermost surface layer of the photosensitive layer is in the range described above, and accordingly, even in a case where an impact is transmitted to the outermost surface layer of the photosensitive layer through the inorganic surface layer, resistance to an impact is obtained and the formation of cracks in the interface between the silica particles and the binder resin and formation of cracks in the binder resin which is present between the silica particles are prevented. In addition, it is assumed that cracks on the outermost surface layer of the photosensitive layer and the inorganic surface layer may be prevented and as a result, formation of image blurring due to cracks may be prevented.

In the photoreceptor according to the first embodiment, it is preferable that the outermost surface layer of the photosensitive layer satisfies the requirement of the charpy impact strength regulated in the second embodiment.

Configuration of Electrophotographic Photoreceptor

Hereinafter, a configuration of the electrophotographic photoreceptor according to the first embodiment and the second embodiment (hereinafter, simply referred to as the "exemplary embodiment" in a case of describing a configuration which is common to both embodiments) will be described in detail with reference to the drawings. The same reference numerals will be used for the same or corresponding parts in the drawings, and the overlapped description thereof will be omitted.

Figure 2:
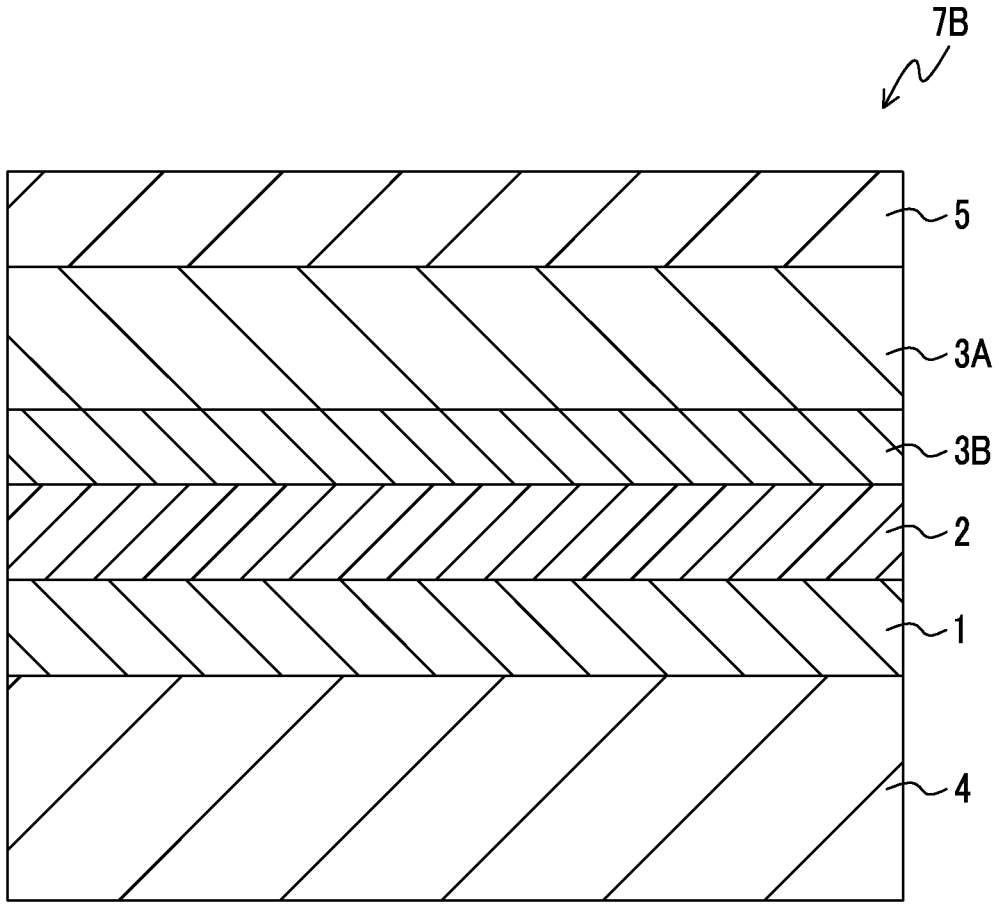
FIG. 2 is a sectional view schematically showing another example of a layer configuration of an electrophotographic photoreceptor of the exemplary embodiment.
Figure 3:
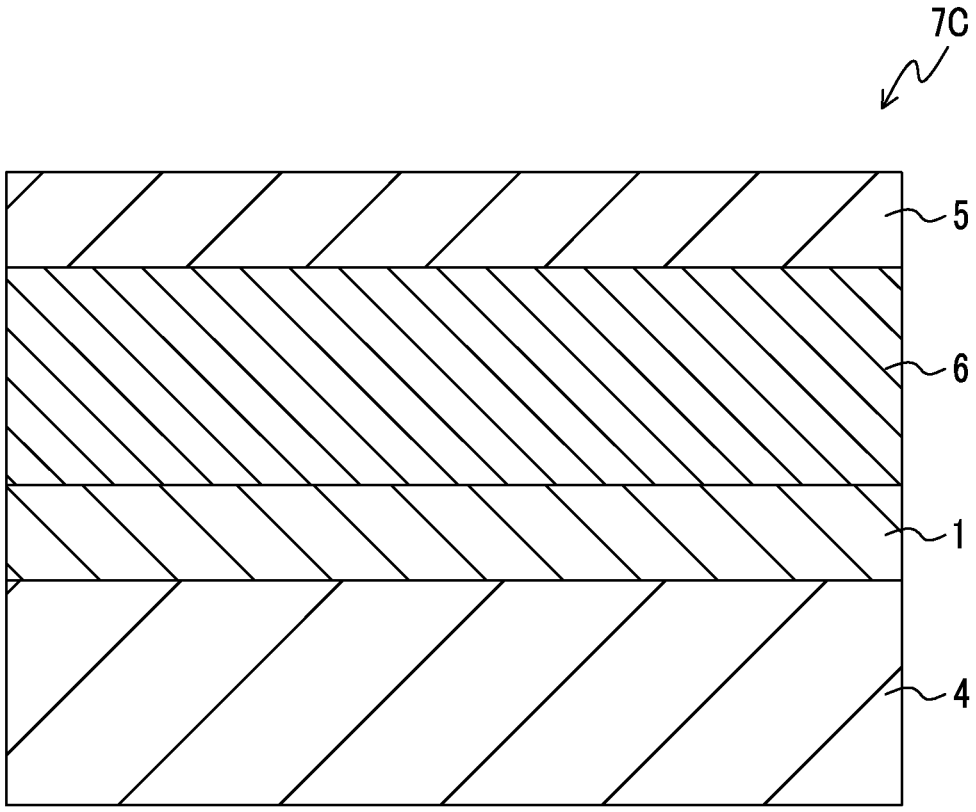
FIG. 3 is a sectional view schematically showing still another example of a layer configuration of an electrophotographic photoreceptor of the exemplary embodiment.

FIG. 1 is a sectional view schematically showing an example of the electrophotographic photoreceptor of the exemplary embodiment. FIGS. 2 and 3 are, respectively, sectional views schematically showing other examples of the electrophotographic photoreceptor of the exemplary embodiment.

An electrophotographic photoreceptor 7A shown in FIG. 1 is a so-called function separation type photoreceptor (or lamination type photoreceptor). An undercoating layer 1 is provided on an electroconductive substrate 4, and a charge generation layer 2, a charge transport layer 3, and an inorganic surface layer 5 are formed thereon in this order. In the electrophotographic photoreceptor 7A, an organic photosensitive layer is configured with the charge generation layer 2 and the charge transport layer 3.

The charge transport layer 3 corresponds to the outermost surface layer of the photosensitive layer and contains at least a charge transport material and silica particles.

In the same manner as that of the electrophotographic photoreceptor 7A shown in FIG. 1, an electrophotographic photoreceptor 7B shown in FIG. 2 is a function separation type photoreceptor in which a function is separated into the charge generation layer 2 and the charge transport layer 3 and the charge transport layer 3 is function-separated. An electrophotographic photoreceptor 7C shown in FIG. 3 includes a charge generation material and a charge transport material in the same layer (single-layer type photosensitive layer 6 (a charge generation/charge transport layer)).

In the electrophotographic photoreceptor 7B shown in FIG. 2, the undercoating layer 1 is provided on the electroconductive substrate 4, and the charge generation layer 2, a charge transport layer 3B, a charge transport layer 3A, and the inorganic surface layer 5 are formed thereon in this order. In the electrophotographic photoreceptor 7B, an organic photosensitive layer is configured with the charge transport layer 3A, the charge transport layer 3B, and the charge generation layer 2.

The charge transport layer 3A corresponds to the outermost surface layer of the photosensitive layer and contains at least a charge transport material and silica particles. Meanwhile, the charge transport layer 3B contains at least a charge transport material without containing silica particles.

In the electrophotographic photoreceptor 7C shown in FIG. 3, the undercoating layer 1 is provided on the electroconductive substrate 4, and the single-layer type organic photosensitive layer 6 and the inorganic surface layer 5 are formed thereon in this order.

The single-layer type organic photosensitive layer 6 corresponds to the outermost surface layer of the photosensitive layer and contains at least a charge generation material, a charge transport material, and silica particles.

In the electrophotographic photoreceptors shown in FIGS. 1 to 3, the undercoating layer 1 may be provided or may not be provided.

Hereinafter, each element will be described based on the electrophotographic photoreceptor 7A shown in FIG. 1 as a representative example.

Electroconductive Substrate

Examples of the electroconductive substrate include a metal plate, a metal drum, and a metal belt containing metal (aluminum, copper, zinc, chromium, nickel, molybdenum, vanadium, indium, gold, or platinum) or an alloy (stainless steel or the like). Examples of the electroconductive substrate further include paper, a resin film, and a belt obtained by coating, evaporating, or laminating a conductive compound (for example, a conductive polymer or indium oxide), metal (for example, aluminum, palladium, or gold), or an alloy. Herein, "conductivity" indicates volume resistivity of less than $10^{13}$ Ωcm.

In a case where the electrophotographic photoreceptor is used in a laser printer, the surface of the electroconductive substrate is preferably roughened to have a center line average roughness Ra of 0.04 μm to 0.5 μm, in order to prevent interference fringes which may be generated when emitting a laser beam. In a case where incoherent light is used as a light source, the roughening for prevention of the interference fringes is not particularly necessary, but the roughening prevents the formation of defects due to irregularities of the surface of the electroconductive substrate, and therefore, is suitable for a longer service life of the product.

As a roughening method, wet honing performed by suspending an abrasive in water and spraying this solution onto a support, centerless grinding for performing press-contact of the electroconductive substrate against a rotating grinding stone and continuously performing a grinding process, or an anodic oxidation treatment is used, for example.

As the roughening method, a method of dispersing conductive or semiconductive powder in a resin to form a layer on a surface of the electroconductive substrate, and performing the roughening by particles dispersed in the layer, without roughening the surface of the electroconductive substrate, is also used.

In the roughening process by anodic oxidation, the anodic oxidation is performed in an electrolyte solution by setting a metal (for example, aluminum) electroconductive substrate as an anode, to form an oxide film on the surface of the electroconductive substrate. Examples of the electrolyte solution include a sulphuric acid solution or an oxalate solution. However, a porous anodic oxide film formed by the anodic oxidation is chemically active in its state, and thus is easily contaminated and has great resistance variation depending on the environment. Therefore, with respect to the porous anodic oxide film, it is preferable to perform a sealing process of sealing micropores of the oxide film by volume expansion due to a hydration reaction in steam under pressure or boiling water (metal salt such as nickel may be added) and changing the oxide film to a more stable hydrous oxide.

A film thickness of the anodic oxide film is, for example, preferably from 0.3 μm to 15 μm. When the film thickness thereof is in the range described above, a barrier property with respect to injection tends to be exhibited and an increase in residual potential due to repeated use tends to be prevented.

A treatment performed by an acidic treatment solution or a boehmite treatment may be performed for the electroconductive substrate.

The treatment performed by an acidic treatment solution is, for example, performed as follows. First, the acidic treatment solution including phosphoric acid, chromic acid, and hydrofluoric acid is prepared. Regarding a combination rate of phosphoric acid, chromic acid, and hydrofluoric acid in the acidic treatment solution, for example, the combination rate of phosphoric acid is in a range of 10% by weight to 11% by weight, the combination rate of chromic acid is in a range of 3% by weight to 5% by weight, and the combination rate of hydrofluoric acid is in a range of 0.5% by weight to 2% by weight. The concentration of the entirety of acids may be in a range of 13.5% by weight to 18% by weight. A treatment temperature is, for example, preferably from 42° C. to 48° C. A film thickness of a coated film is preferably from 0.3 μm to 15 μm.

The boehmite treatment is performed by dipping the electroconductive substrate in pure water at 90° C. to 100° C. for 5 minutes to 60 minutes, or by bringing the electroconductive substrate into contact with heated steam at 90° C. to 120° C. for 5 minutes to 60 minutes, for example. A film thickness of a coated film is preferably from 0.1 μm to 5 μm. This may be further subjected to the anodic oxidation treatment using an electrolyte solution having a low solubility to the coated film, such as adipic acid, boric acid, borate, phosphate, phthalate, maleate, benzoate, tartrate, or citrate.

Undercoating Layer

The undercoating layer is, for example, a layer including inorganic particles and a binder resin.

As the inorganic particles, inorganic particles having powder resistivity (volume resistivity) of $10^2$ Ωcm to $10^{11}$ Ωcm are used, for example.

Among these, as the inorganic particles having the resistivity described above, for example, metal oxide particles such as tin oxide particles, titanium oxide particles, zinc oxide particles, or zirconium oxide particles is used, and zinc oxide particles are particularly preferable.

A specific surface area of the inorganic particles obtained by the BET method may be, for example, equal to or greater than 10 $m^2/g$.

A volume average particle diameter of the inorganic particles may be, for example, from 50 nm to 2,000 nm (preferably from 60 nm to 1,000 nm).

A content of the inorganic particles is, for example, preferably from 10% by weight to 80% by weight and more preferably from 40% by weight to 80% by weight, with respect to the binder resin.

The inorganic particles may be subjected to a surface treatment. The inorganic particles may be used in combination of two or more kinds of inorganic particles which are subjected to different surface treatments or have different particle diameters.

Examples of a surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropyl methyl dimethoxy silane, and N,N-bis(2-hydroxyethyl)-3-aminopropyltriethoxysilane, but there is no limitation.

The silane coupling agent may be used in combination of two or more kinds thereof. For example, the silane coupling agent having an amino group and another silane coupling agent may be used in combination. Examples of the other silane coupling agent include vinyl trimethoxy silane, 3-methacryloxypropyl-tris(2-methoxyethoxy)silane, 2-(3,4-epoxy cyclohexyl)ethyl trimethoxy silane, 3-glycidoxypropyl trimethoxysilane, vinyltriacetoxysilane, 3-mercaptopropyl trimethoxysilane, 3-aminopropyltriethoxysilane, N-2-(aminoethyl)-3-aminopropyltrimethoxysilane, N-2-(aminoethyl)-3-aminopropyl methyl dimethoxy silane, N,N-bis(2-hydroxyethyl)-3-aminopropyltriethoxysilane, and 3-chloropropyl trimethoxysilane, but there is no limitation.

The surface treatment method to be performed by the surface treatment agent may be any method as long as it is a well-known method, and may be either one of a dry method and a wet method.

An amount of the surface treatment agent used is, for example, preferably from 0.5% by weight to 10% by weight with respect to the inorganic particles.

Herein, the undercoating layer may include an electron accepting compound (accepter compound) with the inorganic particles, in order to improve long term stability of the electrical characteristics and a carrier blocking property.

Examples of the electron accepting compound include electron transport substances such as a quinone compound such as chloranil or bromanil; a tetracyanoquinodimethane compound; a fluorenone compound such as 2,4,7-trinitrofluorenone or 2,4,5,7-tetranitro-9-fluorenone; an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis (4-diethylaminophenyl)-1,3,4-oxadiazole; a xanthone compound; a thiophene compound; and a diphenoquinone compound such as 3,3',5,5' tetra-t-butyl diphenoquinone.

Particularly, as the electron accepting compound, a compound having an anthraquinone structure is preferable. Examples of the compound having an anthraquinone structure preferably include a hydroxyanthraquinone compound, an amino anthraquinone compound, and an amino hydroxyanthraquinone compound, and specifically, anthraquinone, alizarin, quinizarin, anthrarufin, and purpurin are preferable.

The electron accepting compound may be included in the undercoating layer to be dispersed with the inorganic particles, or may be included in the undercoating layer in a state of being attached to the surface of the inorganic particles.

As a method of attaching the electron accepting compound to the surface of the inorganic particles, a dry method or a wet method is used, for example.

The dry method is, for example, a method of attaching the electron accepting compound to the surface of the inorganic particles directly or by dripping the electron accepting compound dissolved in an organic solvent and spraying this onto the surface of the inorganic particles with dry air or nitrogen gas, while stirring the inorganic particles with a mixer having great shear force. The dripping or spraying of the electron accepting compound may be performed at a temperature equal to or lower than a boiling point of the solvent. After dripping or spraying the electron accepting compound, baking may be performed at a temperature equal to or higher than 100° C. The conditions of the baking are not particularly limited as long as the conditions include a temperature and time at which electrophotographic characteristics are obtained.

The wet method is, for example, a method of dispersing the inorganic particles in a solvent by stirrer, ultrasonic waves, a sand mill, an attritor, or a ball mill, adding the electron accepting compound thereto and stirring or dispersing the mixture, removing the solvent, and attaching the electron accepting compound to the surface of the inorganic particles. As a method of removing the solvent, the solvent is removed by filtration or distillation. After removing the solvent, the baking may be performed at a temperature equal to or higher than 100° C. The conditions of the baking are not particularly limited as long as the conditions include a temperature and time at which electrophotographic characteristics are obtained. In the wet method, moisture in the inorganic particles may be removed before adding the electron accepting compound, and as an example thereof, a method of removing the moisture while stirring and heating the inorganic particles in the solvent or a method of removing the moisture by boiling the inorganic particles with the solvent is used.

The attachment of the electron accepting compound may be performed before or after performing the surface treatment for the inorganic particles by the surface treatment agent, or the attachment of the electron accepting compound and the surface treatment by the surface treatment agent may be performed at the same time.

A content of the electron accepting compound, for example, is from 0.01% by weight to 20% by weight and is preferably from 0.01% by weight to 10% by weight, with respect to the inorganic particles.

Examples of the resin binder to be used in the undercoating layer include a well-known material such as a well-known polymer compound such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, or an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, a urethane resin, an alkyd resin, or an epoxy resin; a zirconium chelate compound; a titanium chelate compound; an aluminum chelate compound; a titanium alkoxide compound; an organic titanium compound; and a silane coupling agent.

Examples of the binder resin to be used in the undercoating layer also include a charge transport resin having a charge transport group, a conductive resin (for example, polyaniline), and the like.

Among these, as the binder resin to be used in the undercoating layer, a resin which is not soluble in a coating solvent of an upper layer is preferable, and particularly, a thermosetting resin such as a urea resin, a phenol resin, a phenol-formaldehyde resin, a melamine resin, a urethane resin, an unsaturated polyester resin, an alkyd resin, or an epoxy resin; and a resin obtained by reaction between at least one kind of resin selected from a group consisting of a polyamide resin, a polyester resin, a polyether resin, a methacrylic resin, an acrylic resin, a polyvinyl alcohol resin, and a polyvinyl acetal resin, and a curing agent are preferable.

In a case where these binder resins are used in combination of two or more kinds thereof, the combination rates thereof are set as necessary.

The undercoating layer may include various additives, in order to improve the electrical characteristics, environmental stability, and image quality.

Examples of the additives include well-known materials such as a polycyclic condensed or azo electron transport pigment, a zirconium chelate compound, a titanium chelate compound, an aluminum chelate compound, a titanium alkoxide compound, an organic titanium compound, and a silane coupling agent. The silane coupling agent is used in the surface treatment of the inorganic particles as described above, but may also be added to the undercoating layer as an additive.

Examples of the silane coupling agent as an additive include vinyl trimethoxy silane, 3-methacryloxypropyl-tris (2-methoxyethoxy)silane, 2-(3,4-epoxy cyclohexyl)ethyl trimethoxy silane, 3-glycidoxypropyl trimethoxy silane, vinyltriacetoxysilane, 3-mercaptopropyl trimethoxysilane, 3-aminopropyltriethoxysilane, N-2-(aminoethyl)-3-aminopropyltrimethoxysilane, N-2-(aminoethyl)-3-aminopropyl methyl methoxy silane, N,N-bis(2-hydroxyethyl)-3-aminopropyltriethoxysilane, and 3-chloropropyl trimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl)titanate, titanium acetylacetonate, poly titanium acetylacetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxy aluminum diisopropylate, aluminum butyrate, diethyl acetoacetate aluminum diisopropylate, and aluminum tris(ethyl acetoacetate).

These additives may be used alone or as a mixture or a polycondensate of plural compounds.

Vickers hardness of the undercoating layer may be equal to or greater than 35.

Surface roughness (ten point average roughness) of the undercoating layer may be adjusted to be in a range of $1/(4n)$ ($n$ is a refractive index of the upper layer) of an exposure laser wavelength $\lambda$ to be used, to $(1/2)/\lambda$, in order to prevent moire fringes.

Resin particles or the like may be added into the undercoating layer in order to adjust the surface roughness. Examples of the resin particles include silicone resin particles and crosslinked polymethylmethacrylate resin particles. In addition, the surface of the undercoating layer may be abraded, in order to adjust the surface roughness. Examples of the abrading method include buffing, sandblast treatment, wet honing, and grinding treatment.

The forming of the undercoating layer is not particularly limited, and a well-known forming method is used. For example, the undercoating layer is formed by forming a coated film of an undercoating layer forming coating solution obtained by adding the above components into a solvent, drying the coated film, and heating the coated film, if necessary.

Examples of the solvent used for preparing the undercoating layer forming coating solution include well-known organic solvents, for example, an alcohol solvent, an aromatic hydrocarbon solvent, a halogenated hydrocarbon solvent, a ketone solvent, a ketone alcohol solvent, an ether solvent, and an ester solvent.

Specific examples of these solvents include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a dispersion method of the inorganic particles when preparing the undercoating layer forming coating solution include well-known methods using a roll mill, a ball mill, a vibration ball mill, an attritor, a sand mill, a colloid mill, and a paint shaker.

Examples of the method of applying the undercoating layer forming coating solution onto the electroconductive substrate include general methods such as a blade coating method, a wire bar coating method, a spray coating method, a dip coating method, a bead coating method, an air-knife coating method, and a curtain coating method.

A film thickness of the undercoating layer is set, for example, preferably in a range equal to or greater than 15 μm and more preferably in a range of 20 μm to 50 μm.

Intermediate Layer

Although not shown, an intermediate layer may be further provided between the undercoating layer and the photosensitive layer.

The intermediate layer is, for example, a layer including a resin. Examples of the resin used in the intermediate layer include polymer compounds such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin.

The intermediate layer may be a layer including an organic metal compound. Examples of the organic metal compound used in the intermediate layer include organic metal compounds containing metal atoms such as zirconium, titanium, aluminum, manganese, and silicon.

These compounds used in the intermediate layer may be used alone or as a mixture or a polycondensate of plural compounds.

Among these, the intermediate layer is preferably a layer including an organic metal compound containing zirconium atoms or silicon atoms.

The forming of the intermediate layer is not particularly limited, and a well-known forming method is used. For example, the intermediate layer is formed by forming a coated film of an intermediate layer forming coating solution obtained by adding the above components into a solvent, drying the coated film, and heating the coated film, if necessary.

Examples of a coating method for forming the intermediate layer include general methods such as a dip coating method, a extrusion coating method, a wire bar coating method, a spray coating method, a blade coating method, a knife coating method, and a curtain coating method.

A film thickness of the intermediate layer is, for example, preferably set in a range of 0.1 μm to 3 μm. In addition, the intermediate layer may be used as the undercoating layer.

Charge Generation Layer

The charge generation layer is, for example, a layer including a charge generation material and a binder resin. The charge generation layer may be a vapor-deposited layer of the charge generation material. The vapor-deposited layer of the charge generation material is preferable in a case of using incoherent light source such as a light emitting diode (LED) or an organic electro-luminescence (EL) image array.

Examples of the charge generation material include an azo pigment such as bisazo or trisazo; a condensed aromatic pigment such as dibromoanthanthrone; a perylene pigment; a pyrrolopyrrole pigment; a phthalocyanine pigment; zinc oxide; and trigonal selenium.

Among these, a metal phthalocyanine pigment or a metal-free phthalocyanine pigment is preferably used as the charge generation material, in order to respond to near-infrared laser exposure. Specifically, hydroxygallium phthalocyanine; chlorogallium phthalocyanine; dichloro-tin phthalocyanine; and titanyl phthalocyanine are more preferable, for example.

Meanwhile, a condensed aromatic pigment such as dibromoanthanthrone; a thioindigo pigment; a porphyrazine compound; zinc oxide; trigonal selenium; and a bisazo pigment are preferable as the charge generation material, in order to respond to near-ultraviolet laser exposure.

The charge generation materials described above may be used even in a case of using the incoherent light source such as an LED or an organic EL image array having a center wavelength of light of 450 nm to 780 nm. However, in a viewpoint of resolution, when using the photosensitive layer with a thin film having a thickness equal to or smaller than 20 μm, field intensity in the photosensitive layer increases, and a decrease in charging due to charge injection from the base and image defects which are so-called black spots easily occur. This phenomenon significantly occurs when using a charge generation material such as trigonal selenium or phthalocyanine pigment which easily generates dark current in a p-type semiconductor.

With respect to this, when an n-type semiconductor such as a condensed aromatic pigment, a perylene pigment, or an azo pigment is used as the charge generation material, the dark current is hardly generated, and the image defects called black spots may be prevented even in a case of using a thin film. As the n-type charge generation material, compounds (CG-1) to (CG-27) disclosed in paragraphs [0288] to [0291] of JP-A-2012-155282 are used, for example, but there is no limitation.

The determination of the n-type is performed by polarity of flowing photocurrent, using a generally used time-of-flight method, and a material which easily causes electrons to flow as a carrier than holes is determined as the n-type.

The binder resin used in the charge generation layer is selected from a wide range of insulation resins, and the binder resin may be selected from organic photoconductive polymers such as poly-N-vinylcarbazole, polyvinyl anthracene, polyvinyl pyrene, and polysilane.

Examples of the binder resin include a polyvinyl butyral resin, a polyarylate resin (polycondensate of bisphenols and aromatic divalent carboxylic acid), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, and a polyvinyl pyrrolidone resin. Herein, an "insulation property" indicates volume resistivity equal to or greater than $10^{13}$ Ωcm.

These binder resins are used alone or in combination of two or more kinds thereof.

A combination ratio of the charge generation material and the binder resin is preferably in a range of 10:1 to 1:10 in terms of a weight ratio.

The charge generation layer may additionally include other well-known additives.

The forming of the charge generation layer is not particularly limited, and a well-known forming method is used. For example, the charge generation layer is formed by forming a coated film of a charge generation layer forming coating solution obtained by adding the above components into a solvent, drying the coated film, and heating the coated film, if necessary. The forming of the charge generation layer may be performed by vapor deposition of the charge generation material. The forming of the charge generation layer by the vapor deposition is particularly preferable, in a case of using the condensed aromatic pigment or the perylene pigment as the charge generation material.

Examples of the solvent used for preparing the charge generation layer forming coating solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or in combination of two or more kinds thereof.

As a method of dispersing particles (for example, charge generation material) in the charge generation layer forming coating solution, a media dispersion instrument such as a ball mill, a vibration ball mill, an attritor, a sand mill, or a horizontal sand mill, or a media-less dispersion instrument such as a stirrer, an ultrasonic wave dispersion instrument, a roll mill, or a high-pressure homogenizer is used, for example. As the high-pressure homogenizer, a collision type of dispersing a dispersion by causing liquid-liquid collision or liquid-wall collision in a high pressure state, or a flow-through method of dispersing a dispersion by causing the dispersion to flow through a minute flow path in a high pressure state is used, for example.

When performing the dispersion, an average particle diameter of the charge generation materials in the charge generation layer forming coating solution is equal to or smaller than 0.5 μm, preferably equal to or smaller than 0.3 μm, and more preferably equal to or smaller than 0.15 μm.

Examples of applying the charge generation layer forming coating solution onto the undercoating layer (or onto the intermediate layer) include general methods such as a blade coating method, a wire bar coating method, a spray coating method, a dip coating method, a bead coating method, an air-knife coating method, and a curtain coating method.

A film thickness of the charge generation layer is set, for example, preferably in a range of 0.1 μm to 5.0 μm and more preferably in a range of 0.2 μm to 2.0 μm.

Charge Transport Layer

The charge transport layer which is the outermost surface layer of the photosensitive layer will be described by dividing into the charge transport layer of the photoreceptor according to the first embodiment and the charge transport layer of the photoreceptor according to the second embodiment.

Charge Transport Layer According to First Embodiment (Outermost Surface Layer of Photosensitive Layer)

In the first embodiment, the charge transport layer includes the silica particles, the binder resin, and the charge transport material.

Binder Resin

The charge transport layer which is the outermost surface layer of the photosensitive layer in the first embodiment, contains a biphenyl copolymerization type polycarbonate resin (hereinafter, also simply referred to as a "BP polycarbonate resin") including a structural unit represented by the formula (PCA) and a structural unit represented by the formula (PCB) at a copolymerization ratio (PCA:PCB (molar ratio)) of 10:90 to 50:50, as the binder resin.

When the structural unit represented by the formula (PCA) is contained in a range of proportion of 10 or more (that is, the structural unit represented by the formula (PCB) is contained in a range of proportion of 90 or less), the formation of cracks in the interface between the silica particles and the binder resin in the charge transport layer and the formation of cracks in the binder resin which is present between the silica particles are prevented, and cracks on the outermost surface layer of the photosensitive layer and the inorganic surface layer may be prevented.

Meanwhile, when the structural unit represented by the formula (PCA) is contained in a range of proportion of 50 or less (that is, the structural unit represented by the formula (PCB) is contained in a range of proportion of 50 or more), it is effective that cracks on a film is hardly formed.

It is preferable that the copolymerization ratio (PCA:PCB (molar ratio)) of the structural unit represented by the formula (PCA) and the structural unit represented by the formula (PCB) of the BP polycarbonate resin is in a range of 15:85 to 40:60.

(PCA)

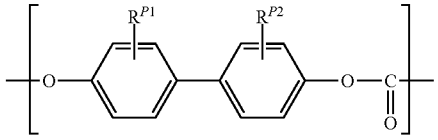

(PCB)

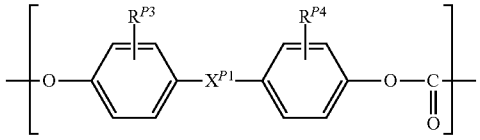

In the formulae (PCA) and (PCB), $R^{P1}$, $R^{P2}$, $R^{P3}$, and $R^{P4}$ each independently represent a hydrogen atom, a halogen atom, an alkyl group having 1 to 6 carbon atoms, a cycloalkyl group having 5 to 7 carbon atoms, or an aryl group having 6 to 12 carbon atoms. $X^{P1}$ represents a phenylene group, a biphenylene group, a naphthylene group, an alkylene group, or a cycloalkylene group.

In the formulae (PCA) and (PCB), examples of an alkyl group represented by $R^{P1}$, $R^{P2}$, $R^{P3}$, and $R^{P4}$ include a linear or branched alkyl group having 1 to 6 carbon atoms (preferably 1 to 3 carbon atoms).

Specific examples of a linear alkyl group include a methyl group, an ethyl group, a n-propyl group, a n-butyl group, a n-pentyl group, and n-hexyl group.

Specific examples of a branched alkyl group include an isopropyl group, an isobutyl group, a sec-butyl group, a tert-butyl group, an isopentyl group, a neopentyl group, a tert-pentyl group, an isohexyl group, a sec-hexyl, and a tert-hexyl group.

Among these, a lower alkyl group such as a methyl group or an ethyl group is preferable as an alkyl group.

In the formulae (PCA) and (PCB), examples of a cycloalkyl group represented by $R^{P1}$, $R^{P2}$, $R^{P3}$, and $R^{P4}$ include cyclopentyl, cyclohexyl, and cycloheptyl.

In the formulae (PCA) and (PCB), examples of an aryl group represented by $R^{P1}$, $R^{P2}$, $R^{P3}$, and $R^{P4}$ include a phenyl group, a naphthyl group, and a biphenylyl group.

In the formulae (PCA) and (PCB), examples of alkylene group represented by $X^{P1}$ include a linear or branched alkylene group having 1 to 12 carbon atoms (preferably 1 to 6 carbon atoms and more preferably 1 to 3 carbon atoms).

Specific examples of a linear alkylene group include a methylene group, an ethylene group, a n-propylene group, a n-butylene group, a n-pentylene group, a n-hexylene group, a n-heptylene group, a n-octylene group, a n-nonylene group, a n-decylene group, a n-undecylene group, and a n-dodecylene group.

Specific examples of a branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, and a neododecylene group.

Among these, a lower alkyl group such as a methylene group, an ethylene group, or a butylene group is preferable as an alkylene group.

In the formulae (PCA) and (PCB), examples of a cycloalkylene group represented by $X^{P1}$ include a cycloalkylene group having 3 to 12 carbon atoms (preferably 3 to 10 carbon atoms and more preferably 5 to 8 carbon atoms).

Specific examples of a cycloalkylene group include a cyclopropylene group, a cyclopentylene group, a cyclohexylene group, a cyclooctylene group, and a cyclododecanylene group.

Among these, a cyclohexylene group is preferable as a cycloalkylene group.

In the formulae (PCA) and (PCB), each substituent represented by $R^{P1}$, $R^{P2}$, $R^{P3}$, $R^{P4}$, and $X^{P1}$ further includes a group having a substituent. Examples of this substituent include a halogen atom (for example, fluorine atom or a chlorine atom), an alkyl group (for example, an alkyl group having 1 to 6 carbon atoms), a cycloalkyl group (for example, a cycloalkyl group having 5 to 7 carbon atoms), an alkoxy group (for example, an alkoxy group having 1 to 4 carbon atoms), and an aryl group (for example, a phenyl group, a naphthyl group, or a biphenylyl group).

In the formula (PCA), it is preferable that $R^{P1}$ and $R^{P2}$ each independently represent a hydrogen atom or an alkyl group having 1 to 6 carbon atoms and it is more preferable that $R^{P1}$ and $R^{P2}$ represent a hydrogen atom.

In the formula (PCB), it is preferable that $R^{P3}$ and $R^{P4}$ each independently represent a hydrogen atom or an alkyl group having 1 to 6 carbon atoms and $X^{P1}$ represents an alkylene group or a cycloalkylene group.

Specific examples of the BP polycarbonate resin include the followings but there is no limitation. In exemplified compounds, terms pm and pn indicate a copolymerization ratio.

(PC-1)

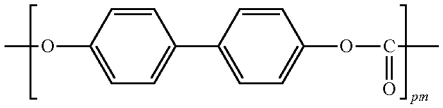

-continued

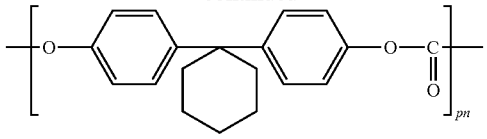

(PC-2)

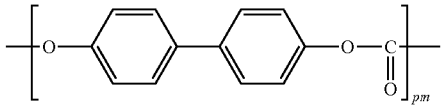

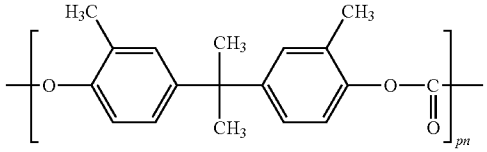

(PC-3)

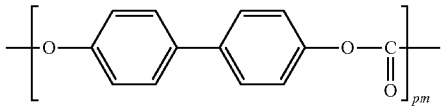

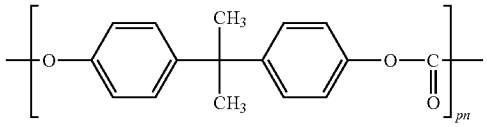

Among the specific examples described above, (PC-1) is more preferable as the BP polycarbonate resin.

A viscosity average molecular weight of the BP polycarbonate resin is, for example, preferably from 20,000 to 80,000, more preferably from 30,000 to 70,000, and even more preferably from 30,000 to 60,000.

A value is measured by the following method as a method of measuring the viscosity average molecular weight of the BP polycarbonate resin. 1 g of a resin is dissolved in 100 $cm^3$ of methylene chloride, specific viscosity ηsp thereof is measured using a Ubbelohde viscometer in a measurement environment at 25° C., limiting viscosity $[_1]$ ($cm^3/g$) is determined with a relational expression of $\eta sp/c=[\eta]+0.45[\eta]2c$ (herein, c is concentration ($g/cm^3$)), and a viscosity average molecular weight Mv is determined by an expression obtained by H. Schnell, which is a relational expression of $[\eta]=1.23\times10^{-4}\ Mv^{0.83}$.

As the BP polycarbonate resin, other binder resins may be used in combination. Herein, the other binder resins may be combined by an amount of 10% by weight (preferably, 5% by weight or less) with respect to the entire binder resin.

Herein, the content of the BP polycarbonate resin is preferably from 5% by weight to 65% by weight, more preferably from 10% by weight to 55% by weight, and even more preferably from 15% by weight to 40% by weight, with respect to the entire solid content of the outermost surface layer (charge transport layer) of the photosensitive layer.

A combination ratio of the entire binder resin and the charge transport material (weight ratio=binder resin:charge transport material) is preferably from 10:1 to 1:5.

Charge Transport Layer According to Second Embodiment (Outermost Surface Layer of Photosensitive Layer)

In the second embodiment, the charge transport layer includes the silica particles, the binder resin, and the charge transport material. The charpy impact strength of the charge transport layer (outermost surface layer of the photosensitive layer) is from 12 $kJ/m^2$ to 35 $kJ/m^2$.

Charpy Impact Strength

In the second embodiment, when the charpy impact strength of the charge transport layer (outermost surface layer of the photosensitive layer) is equal to or greater than 12 kJ/m$^2$, the formation of cracks in the interface between the silica particles and the binder resin in the charge transport layer and the formation of cracks in the binder resin which is present between the silica particles are prevented, and cracks on the outermost surface layer of the photosensitive layer and the inorganic surface layer may be prevented.

Meanwhile, when charpy impact strength thereof is equal to or smaller than 35 kJ/m$^2$, it is effective that coating is performed without peeling of a film.

The charpy impact strength of the charge transport layer (outermost surface layer of the photosensitive layer) is more preferably in a range of 13 kJ/m$^2$ to 30 kJ/m$^2$ and even more preferably in a range of 14 kJ/m$^2$ to 25 kJ/m$^2$.

In the measurement of the charpy impact strength of the charge transport layer (outermost surface layer of the photosensitive layer), an ISO multipurpose dumbbell test piece is processed from the charge transport layer (outermost surface layer of the photosensitive layer) based on ISO 179 and notch charpy impact strength (kJ/m$^2$) is measured based on ISO 179 using a digital impact resistance testing device (DZ-GI manufactured by Toyo Seiki Seisaku-sho, Ltd.).

The charpy impact strength of the charge transport layer (outermost surface layer of the photosensitive layer) may be controlled by adjusting the kind of the binder resin used in the charge transport layer (outermost surface layer of the photosensitive layer), the molecular weight of the binder resin, and content of the binder resin.

Binder Resin

In the second embodiment, the binder resin used in the charge transport layer which is the outermost surface layer of the photosensitive layer is not particularly limited and a well-known binder resin may be used.

Examples of the binder resin used in the charge transport layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinylcarbazole, and polysilane. Among these, a polycarbonate resin or a polyarylate resin is preferable as the binder resin. These binder resins are used alone or in combination of two or more kinds thereof.

A combination ratio of the charge transport material and the binder resin is preferably from 10:1 to 1:5 in terms of a weight ratio.

However, in order to control the charpy impact strength of the charge transport layer in the range described above, it is preferable to use a biphenyl copolymerization type polycarbonate resin and, particularly, it is more preferable to use a biphenyl copolymerization type polycarbonate resin (BP polycarbonate resin) including a structural unit represented by the formula (PCA) and a structural unit represented by the formula (PCB) at a copolymerization ratio (PCA:PCB (molar ratio)) of 10:90 to 50:50 which is described in the first embodiment.

The configurations described in the first embodiment are preferably used for the preferable range of the copolymerization ratio (PCA:PCB (molar ratio)), the preferable structure of each of the structural unit represented by the formula (PCA) and the structural unit represented by the formula (PCB), the preferable range of the molecular weight, the preferable content, and the like.

Common Matter in First and Second Embodiments

Next, common matters in the first and second embodiments (exemplary embodiments) regarding the charge transport layer which is the outermost surface layer of the photosensitive layer will be described.

Silica Particles

The charge transport layer which is the outermost surface layer of the photosensitive layer in the exemplary embodiment contains from 30% by weight to 70% by weight of the silica particles with respect to the entire charge transport layer. When 30% by weight or more of the silica particles are contained, the charge transport layer (outermost surface layer of the photosensitive layer) is reinforced and deformation of the charge transport layer may be prevented. Meanwhile, when 70% by weight or less of the silica particles are contained, precipitation of silica particles is prevented and coating may be performed without peeling of a film.

The content of the silica particles with respect to the entire charge transport layer is more preferably from 40% by weight to 70% by weight and even more preferably from 45% by weight to 65% by weight.

The content of the silica particles may be greater than the content of the charge transport material.

Examples of the silica particles include dry silica particles and wet silica particles.

Examples of dry silica particles include combustion method silica (fumed silica) obtained by burning a silane compound and deflagration method silica obtained by explosively burning silicon metal powder.

Examples of wet silica particles include wet silica particles (precipitation method silica obtained by synthesis and aggregation under alkaline conditions and gel method silica particles obtained by synthesis and aggregation under acidic conditions) obtained by a neutralization reaction of sodium silicate and mineral acid, colloidal silica particles (silica sol particles) obtained by performing polymerization by alkalifying acidic silicate, sol-gel method silica particles obtained by hydrolysis of an organic silane compound (for example, alkoxysilane).

Among these, as the silica particles, combustion method silica particles having a small amount of a silanol group in the surface and having a low pore structure are preferably used.

A volume average particle diameter of the silica particles may be, for example, from 20 nm to 200 nm, is preferably from 30 nm to 200 nm, and more preferably from 40 nm to 150 nm.

Regarding the volume average particle diameter, silica particles are separated from the layer, 100 primary particles of the silica particles are observed with magnification of 40,000 by a scanning electron microscope (SEM), the maximum diameter and the minimum diameter for each particle are measured by image analysis of the primary particles, and a sphere equivalent diameter is measured from a median value. A diameter with the cumulative percentage of 50% (D50v) of the obtained equivalent spherical diameter is obtained and this is measured as the volume average particle diameter of the silica particles.

The surface of the silica particles may be subjected to surface treatment by a hydrophobizing agent. Accordingly, the amount of the silanol group of the surface of the silica particles is decreased.

Examples of the hydrophobizing agent include well-known silane compounds such as chlorosilane, alkoxysilane, or silazane.

Among these, as the hydrophobizing agent, a silane compound including a trimethylsilyl group, a decylsilyl group, or a phenylsilyl group is preferable. That is, a trimethylsilyl group, a decylsilyl group, or a phenylsilyl group may be included in the surface of the silica particles.

Examples of the silane compound including a trimethylsilyl group include trimethylchlorosilane, trimethylmethoxysilane, and 1,1,1,3,3,3-hexamethyldisilazane.

Examples of the silane compound including a decylsilyl group include decyl trichlorosilane, decyl trichlorosilane, decyl dimethylchlorosilane, and decyltrimethoxysilane.

Examples of the silane compound including a phenyl group include triphenyl methoxy silane, and triphenyl chlorosilane.

A condensation rate of the silica particles treated with a hydrophobizing agent (Si—O—Si ratio of a bonding of $SiO_4$— in silica particles: hereinafter, referred to as a "condensation rate of hydrophobizing agent") may be equal to or greater than 90%, is preferably equal to or greater than 91%, and more preferably equal to or greater than 95% with respect to a silanol group of the surface of the silica particles, for example.

When the condensation rate of the hydrophobizing agent is in the range described above, the amount of the silanol group of the silica particles is decreased.

The condensation rate of the hydrophobizing agent shows a rate of condensed silicon with respect to the entire bondable site of silicon in a condensed part detected by an NMR and is measured as follows.

First, silica particles are separated from the layer. Si CP/MAS NMR analysis is performed with respect to the separated silica particles using AVANCE III 400 manufactured by Bruker Corporation to obtain a peak area according to the number of substitutions of SiO, values of disubstitutions ($Si(OH)_2(O—Si)_2$—), trisubstitutions ($Si(OH)(O—Si)_3$—), and tetrasubstitutions ($Si(O—Si)_4$—) are set as Q2, Q3, and Q4, and the condensation rate of the hydrophobizing agent is calculated with an expression of $(Q2\times 2+Q3\times 3+Q4\times 4)/4\times(Q2+Q3+Q4)$.

A volume resistivity of the silica particles may be equal to or greater than $10^{11}$ Ω·cm, is preferably equal to or greater than $10^{12}$ Ω·cm, and more preferably equal to or greater than $10^{13}$ Ω·cm.

When the volume resistivity of the silica particles is in the range described above, deterioration of thin line reproducibility is prevented.

The volume resistivity of the silica particles is measured as follows. In a measurement environment, a temperature is 20° C. and humidity is 50% RH.

First, silica particles are separated from the layer. The separated silica particles which are a measurement target are loaded on a surface of a circular jig having an electrode plate having a size of 20 $cm^2$ so as to have a thickness of 1 mm to 3 mm and a silica particle layer is formed. The same electrode plate having a size of 20 $cm^2$ is loaded thereon to interpose the silica particle layer. In order to remove spaces between the silica particles, a load of 4 kg is applied onto the electrode plate disposed on the silica particle layer and then, a thickness (cm) of the silica particle layer is measured. Both electrodes on the upper portion and the lower portion of the hydrophobic silica particle layer are connected to an electrometer and a high-voltage power supply device. A high voltage is applied to both electrodes so that an electric field has a measured value and a current value (A) of the current flowing at that time is read to calculate the volume resistivity (Ω·cm) of the silica particles. A calculation equation of the volume resistivity (Ω·cm) of the silica particles is as shown in the following equation.

In the equation, ρ represents the volume resistivity (Ω·cm) of the hydrophobic silica particles, E represents an applied voltage (V), I represents a current value (A), $I_0$ represents a current value (A) when the applied voltage is 0 V, and L represents a thickness (cm) of the hydrophobic silica particle layer, respectively. In the evaluation, the volume resistivity when the applied voltage is 1000 V is used.

$$\rho=E\times 20/(I-I_0)/L \qquad \text{Equation:}$$

Charge Transport Material

Examples of the charge transport material include electron transport compounds such as a quinone compound such as p-benzoquinone, chloranil, bromanil, or anthraquinone; a tetracyanoquinodimethane compound; a fluorenone compound such as 2,4,7-trinitrofluorenone; a xanthone compound; a benzophenone compound; a cyanovinyl compound; and an ethylene compound. Examples of the charge transport material also include hole transport compounds such as a triarylamine compound, a benzidine compound, an arylalkane compound, an aryl-substituted ethylene compound, a stilbene compound, an anthracene compound, and a hydrazone compound. These charge transport materials are used alone or in combination of two or more kinds thereof, but there is no limitation.

As the charge transport material, a triarylamine derivative represented by the structural formula (a-1) and a benzidine derivative represented by the formula (a-2) are preferable, in a viewpoint of charge mobility.

(a-1)

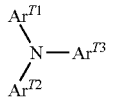

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

As the substituent of each group, a halogen atom, an alkyl group having 1 to 5 carbon atoms, and an alkoxy group having 1 to 5 carbon atoms are used. As the substituent of each group, a substituted amino group substituted with an alkyl group having 1 to 3 carbon atoms is also used.

(a-2)

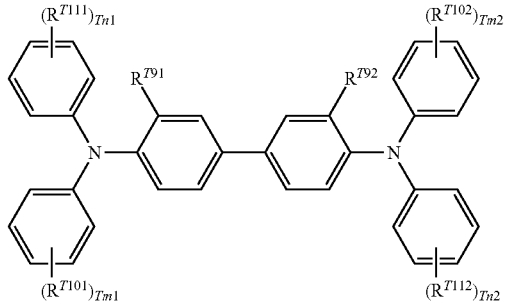

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, —C($R^{T12}$)═C($R^{T13}$)($R^{T14}$), or —CH═CH—CH═C($R^{T15}$)($R^{T16}$) and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

As the substituent of each group, a halogen atom, an alkyl group having 1 to 5 carbon atoms, and an alkoxy group having 1 to 5 carbon atoms are used. As the substituent of each group, a substituted amino group substituted with an alkyl group having 1 to 3 carbon atoms is also used.

Herein, among the triarylamine derivative represented by the formula (a-1) and the benzidine derivative represented by the formula (a-2), a triarylamine derivative having "—$C_6H_4$—CH═CH—CH═C($R^{T7}$)($R^{T8}$)" and a benzidine derivative having "—CH═CH—CH═C($R^{T15}$)($R^{T16}$)" are particularly preferable, in a viewpoint of charge mobility.

As the polymer charge transport material, a well-known material having a charge transport property such as poly-N-vinylcarbazole or polysilane is used. Polyester polymer charge transport materials are particularly preferable.

The content of the charge transport material may be equal to or greater than 40% by weight, is preferably from 40% by weight to 70% by weight, and more preferably from 40% by weight to 60% by weight, with respect to a weight obtained by subtracting the weight of the silica particles from the weight of the entire component of the charge transport layer.

The content of the charge transport material may be smaller than that of the silica particles.

When the content of the charge transport material is in the range described above, generation of a residual potential is easily prevented.

The charge transport layer may additionally include other well-known additives.

The forming of the charge transport layer is not particularly limited, and a well-known forming method is used. For example, the charge transport layer is formed by forming a coated film of a charge transport layer forming coating solution obtained by adding the above components into a solvent, drying the coated film, and heating the coated film, if necessary.

Examples of the solvent used for preparing the charge transport layer forming coating solution include commonly-used organic solvents such as aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and linear or cyclic ethers such as tetrahydrofuran and ethyl ether. These solvents are used alone or in combination of two or more kinds thereof.

Examples of a coating method when applying the charge transport layer forming coating solution onto the charge generation layer include general methods such as a blade coating method, a wire bar coating method, a spray coating method, a dip coating method, a bead coating method, an air-knife coating method, and a curtain coating method.

As a method of dispersing particles (silica particles) in a coating solution for charge transport layer formation, a media dispersion instrument such as a ball mill, a vibration ball mill, an attritor, a sand mill, or a horizontal sand mill, or a media-less dispersion instrument such as a stirrer, an ultrasonic wave dispersion instrument, a roll mill, or a high-pressure homogenizer is used, for example. As the high-pressure homogenizer, a collision type of dispersing a dispersion by causing liquid-liquid collision or liquid-wall collision in a high pressure state, or a flow-through method of dispersing a dispersion by causing the dispersion to flow through a minute flow path in a high pressure state is used, for example.

Characteristics of Charge Transport Layer

Surface roughness Ra (arithmetic average surface roughness Ra) of the surface of the charge transport layer on the inorganic surface layer side may be, for example, equal to or smaller than 0.06 μm, and is preferably equal to or smaller than 0.03 μm and more preferably equal to or smaller than 0.02 μm.

When the surface roughness Ra is in the range described above, cleaning properties are improved.

A method of increasing a thickness of a layer to be incorporated is used, for example, in order to set the surface roughness Ra in the range described above.

The surface roughness Ra is measured as follows.

First, after separating the inorganic surface layer, a layer which is a measurement target is exposed. Apart of the layer is cut by a cutter to obtain a measurement sample.

The surface roughness of this measurement sample is measured using a stylus type surface roughness measuring device (SURFCOM 1400A manufactured by TOKYO SEIMITSU CO., LTD.). In the measurement conditions, an evaluation length Ln is set as 4 mm, a reference length L is set as 0.8 mm, and a cut-off value is set as 0.8 mm based on JIS B0601-1994.

An elastic modulus of the charge transport layer may be, for example, equal to or greater than 5 GPa, and is preferably equal to or greater than 6 GPa and more preferably equal to or greater than 6.5 GPa.

The elastic modulus of the charge transport layer is measured as follows.

First, after separating the inorganic surface layer, a layer which is a measurement target is exposed. Apart of the layer is cut by a cutter to obtain a measurement sample.

A depth profile is obtained by continuous stiffness measurement (CSM) (U.S. Pat. No. 4,848,141) using Nano Indenter SA2 manufactured by MTS Systems Corporation and the elastic modulus is measured using an average value obtained from measurement values at the indentation depth of 30 nm to 100 nm.

A film thickness of the charge transport layer is, for example, set to be in a range of preferably 5 μm to 50 μm and more preferably 10 μm to 30 μm.

Inorganic Surface Layer

Composition of Inorganic Surface Layer

The inorganic surface layer is a layer containing an inorganic material.

Examples of the inorganic material include oxide, nitride, carbon, and silicon inorganic materials, in order to have mechanical strength and translucency as a surface layer.

Examples of the oxide inorganic material include a metal oxide such as gallium oxide, aluminum oxide, zinc oxide, titanium oxide, indium oxide, tin oxide, or boron oxide, or mixed crystal thereof.

Examples of the nitride inorganic material include a metal nitride such as gallium nitride, aluminum nitride, zinc nitride, titanium nitride, indium nitride, tin nitride, or boron nitride, or mixed crystal thereof.

Examples of the carbon and silicon inorganic materials include diamond-like carbon (DLC), amorphous carbon (a-C), hydrogenated amorphous carbon (a-C:H), hydrogen-fluorinated amorphous carbon (a-C:H), amorphous silicon carbide (a-SiC), hydrogenated amorphous silicon carbide (a-SiC:H), amorphous silicon (a-Si), and hydrogenated amorphous silicon (a-Si:H).

The inorganic material may be mixed crystal of oxide and nitride inorganic materials.

Among these, a metal oxide, particularly an oxide which is an element in Group 13 (preferably, gallium oxide) is preferable as the inorganic material, in order to have excellent mechanical strength and translucency, and particularly n type conductivity, and to have excellent conductivity controlling properties.

That is, the inorganic surface layer may contain at least an element in Group 13 (particularly gallium) and an oxygen atom and, if necessary, may contain a hydrogen atom. When the inorganic surface layer contains hydrogen, the physical properties of the inorganic surface layer containing at least an element in Group 13 (particularly gallium) and an oxygen atom is easily controlled.

It is preferable that the sum of an element composition ratio of an element in Group 13, an oxygen atom, and a hydrogen atom with respect to the entirety of elements constituting the inorganic surface layer is equal to or greater than 90 atom %. In a case where the sum of the element composition ratio is equal to or greater than 90 atom % and an element in Group 15 such as N, P, or As, for example, is incorporated, an effect of bonding those and gallium is prevented and it is easy to realize an appropriate range of a composition ratio of an oxygen atom and gallium (oxygen/gallium) for improving hardness or electric characteristics of the inorganic surface layer.

The sum of the element composition ratio is more preferably equal to or greater than 95 atom %, even more preferably equal to or greater than 96 atom %, and particularly preferably equal to or greater than 97 atom %, from the viewpoints described above.

It is preferable that the atomic ratio of element composition of an oxygen atom and an element in Group 13 (oxygen/element in Group 13) is from 1.1 to 1.5. When the atomic ratio of element composition (oxygen/element in Group 13) is equal to or greater than 1.1, hardness of the inorganic surface layer is ensured to prevent mechanical damages, a decrease in electrical resistivity is prevented, deletion of an electrostatic latent image in an in-plane direction is reduced, and it is easy to obtain a resolution of an image. Meanwhile, when the atomic ratio of element composition is equal to or smaller than 1.5, a residual potential may be prevented.

It is more preferable that the atomic ratio of element composition of an oxygen atom and an element in Group 13 (oxygen/element in Group 13) is from 1.1 to 1.4.

When the composition ratio [O]/[Ga] (by atomic ratio) is changed from 1.0 to 1.5 in the inorganic surface layer containing, for example, gallium, an oxygen atom, and a hydrogen atom (inorganic surface layer composed of gallium oxide containing hydrogen, for example), the volume resistivity may be easily controlled to be in a range of $10^9$ Ω·cm to $10^{14}$ Ω·cm.

In addition to the inorganic materials, the inorganic surface layer may contain one or more elements selected from C, Si, Ge, and Sn, in a case of n type, for example, in order to control the conductivity. For example, in a case of p type, the inorganic surface layer may contain one or more elements selected from N, Be, Mg, Ca, and Sr.

Herein, in a case where the inorganic surface layer contains gallium, an oxygen atom, and if necessary, a hydrogen atom, the suitable element composition ratio is as follows, from the viewpoints of excellent mechanical strength, translucency, flexibility, and conductivity controlling properties thereof.

The element composition ratio of gallium may be, for example, from 15 atom % to 50 atom %, is preferably from 20 atom % to 40 atom %, and more preferably from 20 atom % to 30 atom % with respect to the entirety of constituent elements of the inorganic surface layer.

The element composition ratio of an oxygen atom may be, for example, from 30 atom % to 70 atom %, is preferably from 40 atom % to 60 atom %, and more preferably from 45 atom % to 55 atom % with respect to the entirety of constituent elements of the inorganic surface layer.

The element composition ratio of hydrogen may be, for example, from 10 atom % to 40 atom %, is preferably from 15 atom % to 35 atom %, and more preferably from 20 atom % to 30 atom % with respect to the entirety of constituent elements of the inorganic surface layer.

Meanwhile, an atom ratio [oxygen/gallium] may be greater than 1.50 and equal to or smaller than 2.20 and is preferably from 1.6 to 2.0.

Herein, the element composition ratio of each element of the inorganic surface layer and the atom number ratio are determined by Rutherford backscattering (hereinafter, referred to as "RBS"), including distribution in a thickness direction.

In the RBS, 3SDH Pelletron manufactured by NEC Corporation is used as an accelerator, RBS-400 manufactured by CE&A Co., Ltd. is used as an end station, and 3S-R10 is used as a system. In the analysis, HYPRA program manufactured by CE&A Co., Ltd. or the like is used.

In measurement conditions of the RBS, He++ ion beam energy is set as 2.275 eV, a detecting angle is set as 160°, Grazing angle with respect to an incident beam is set as 109°.

The RBS measurement is performed as follows in detail. First, a He++ ion beam is incident perpendicularly to a sample, a detector is set at 160° with respect to the ion beam, and a signal of backscattered He is measured. A composition ratio and a film thickness are determined from the detected He energy and strength. Spectra may also be measured at two detecting angles, in order to improve accuracy for determining the composition ratio and the film thickness. The measurement is performed at two different detecting angles of a resolution in a depth direction and backscatter for crosschecking, so that the accuracy is further improved.

The number of He atoms which are backscattered by a target atom is determined by only three elements of 1) atomic number of a target atom, 2) energy of He atoms before scattering, and 3) a scattering angle.

A density is assumed by calculation from the measured composition and a thickness is calculated using this. An error of the density is within 20%.

The element composition ratio of hydrogen is determined by hydrogen forward scattering (hereinafter, referred to as "HFS").

In the HFS measurement, 3SDH Pelletron manufactured by NEC Corporation is used as an accelerator, RBS-400 manufactured by CE&A Co., Ltd. is used as an end station, and 3S-R10 is used as a system. In the analysis, HYPRA program manufactured by CE&A Co., Ltd. or the like is used. The measurement conditions of HFS are as follows.

He++ ion beam energy: 2.275 eV detecting angle: 160°, Grazing angle with respect to incident beam is 30°

In the HFS measurement, a detector is set at 30° with respect to the He++ ion beam, a sample is set at 75° with respect to a normal line, to follow a signal of hydrogen which is scattering forwards of the sample. At that time, the detector may be covered with aluminum foil and the scattered He atoms may be removed with the hydrogen. Quantitation is performed by standardizing the numbers of hydrogen atoms of a reference sample and a measurement sample by stopping power and then comparing those. A sample obtained by performing ion implantation of H in Si and white mica are used as reference sample.

It is known that the white mica has hydrogen concentration of 6.5 atom %.

The amount of H adsorbed to the outermost surface is, for example, corrected by subtracting the amount of H adsorbed to the pure Si surface.

Characteristics of Inorganic Surface Layer

The inorganic surface layer may have distribution at a composition ratio in a thickness direction or may have a multi-layer configuration, according to the purpose.

The inorganic surface layer is preferably a non-single crystal film such as a fine crystal film, a polycrystalline film, or an amorphous film. Among these, the amorphous properties are particularly preferable from a viewpoint of smoothness of a surface and the fine crystal film is more preferable from a viewpoint of hardness.

A growth section of the inorganic surface layer may have a columnar structure, but a structure having high flatness is preferable from a viewpoint of sliding properties and the amorphous properties are preferable.

The crystallinity and the amorphous properties are determined with presence or absence of a point or a line of a diffraction image obtained by reflection high-energy electron diffraction (RHEED) measurement.

The volume resistivity of the inorganic surface layer may be equal to or greater than $10^6$ Ω·cm and is preferably equal to or greater than $10^8$ Ω·cm.

When the volume resistivity is in the range described above, the charge flowing in the in-plane direction is prevented and it is easy to realize excellent electrostatic latent image formation.

The volume resistivity is determined by performing calculation based on an electrode area and a sample thickness from a resistance value measured under conditions of a frequency of 1 kHz and a voltage of 1 V using LCR meter ZM2371 manufactured by NF Corporation.

The measurement sample may be a sample which is obtained by forming a film on an aluminum base material under the same conditions as when forming the inorganic surface layer which is a measurement target and forming a gold electrode on the formed film by vacuum deposition, or may be a sample which is obtained by separating the inorganic surface layer from the prepared electrophotographic photoreceptor, etching apart of the layer, and interposing this between a pair of electrodes.

An elastic modulus of the inorganic surface layer may be from 30 GPa to 80 GPa and is preferably from 40 GPa to 65 GPa.

When the elastic modulus is in the range described above, formation of recesses (dent scratches) in the inorganic surface layer or peeling or cracks thereof are easily prevented.

As this elastic modulus, a depth profile is obtained by continuous stiffness measurement (CSM) (U.S. Pat. No. 4,848,141) using Nano Indenter SA2 manufactured by MTS Systems Corporation and an average value obtained from measurement values at the indentation depth of 30 nm to 100 nm is used. The following are measurement conditions.

Measurement environment: 23° C., 55% RH

Indenter used: diamond regular triangular pyramid indenter (Berkovic indenter) triangular pyramid indenter Test mode: CSM mode The measurement sample may be a sample which is obtained by forming a film on a base material under the same conditions as when forming the inorganic surface layer which is a measurement target or may a sample which is obtained by separating the inorganic surface layer from the prepared electrophotographic photoreceptor and etching a part of the layer.

A thickness of the inorganic surface layer may be, for example, from 0.2 μm to 10.0 μm and is preferably from 0.4 μm to 5.0 μm.

When the thickness thereof is in the range described above, formation of recesses (dent scratches) in the inorganic surface layer or peeling or cracks thereof are easily prevented.

Formation of Inorganic Surface Layer

In the formation of the surface layer, well-known vapor phase film forming methods such as a plasma chemical vapor deposition (CVD) method, an organic metal vapor phase growing method, a molecular beam epitaxy method, a vapor deposition, and sputtering are used, for example.

Hereinafter, the formation of the inorganic surface layer will be described by showing an example of a film forming apparatus in the drawing and using specific examples. In the following description, a method of forming the inorganic surface layer containing gallium, an oxygen atom, and a hydrogen atom will be described, but there is no limitation, and a well-known forming method may be used according to composition of the aiming inorganic surface layer.

Figure 4A:
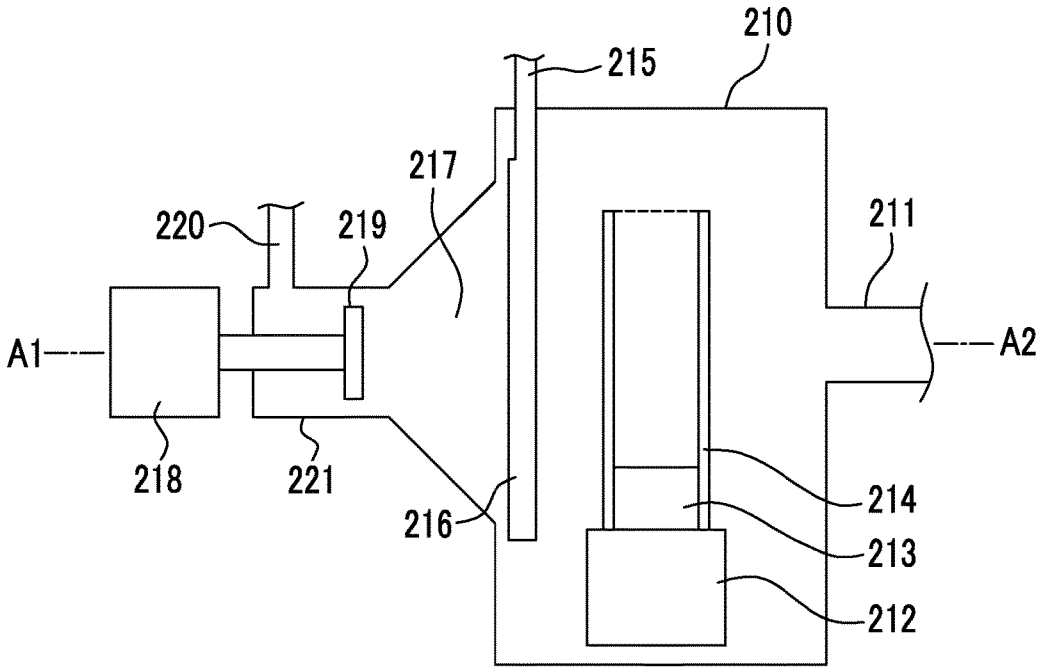
FIGS. 4A and 4B are schematic views showing an example of a film forming apparatus used for forming an inorganic protection layer of the electrophotographic photoreceptor of the exemplary embodiment.
Figure 4B:
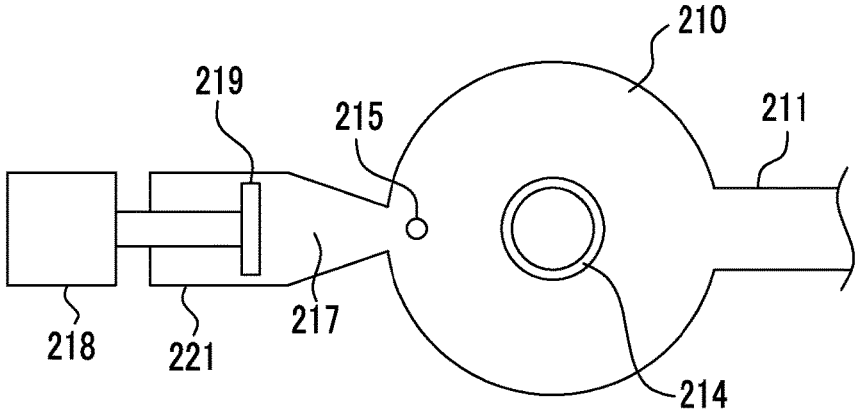

FIGS. 4A and 4B are schematic views showing an example of a film forming apparatus used for forming the inorganic surface layer of the electrophotographic photoreceptor of the exemplary embodiment, in which FIG. 4A shows a schematic sectional view in a case where the film forming apparatus is seen from the side surface and FIG. 4B shows a schematic sectional view between A1 and A2 of the film forming apparatus shown in FIG. 4A. In FIGS. 4A and 4B, a reference numeral 210 indicates a film forming chamber, a reference numeral 211 indicates an exhaust port, a reference numeral 212 indicates a base rotation unit, a reference numeral 213 indicates a base support, a reference numeral 214 indicates a base, a reference numeral 215 indicates a gas introduction tube, a reference numeral 216 indicates a shower nozzle including an opening for ejecting gas introduced from the gas introduction tube 215, a reference numeral 217 indicates a plasma diffusion unit, a reference numeral 218 indicates a high frequency power supply unit, a reference numeral 219 indicates a flat electrode, a reference numeral 220 indicates a gas introduction tube, and a reference numeral 221 indicates a high frequency discharge tube unit.

In the film forming apparatus shown in FIGS. 4A and 4B, the exhaust port 211 connected to a vacuum exhaust device (not shown) is provided on one end of the film forming chamber 210, and a plasma generation apparatus formed of the high frequency power supply unit 218, the flat electrode 219, and the high frequency discharge tube unit 221 is provided on a side of the film forming chamber 210 which is opposite to the side where the exhaust port 211 is provided.

The plasma generation apparatus is configured with the high frequency discharge tube unit 221, the flat electrode 219 which is disposed in the high frequency discharge tube unit 221 and in which a discharge surface is provided on the exhaust port 211 side, and the high frequency power supply unit 218 which is provided outside of the high frequency discharge tube unit 221 and connected to a surface which is opposite side of the discharge surface of the flat electrode 219. The gas introduction tube 220 for supplying gas into the high frequency discharge tube unit 221 is connected to the high frequency discharge tube unit 221, and another end of the gas introduction tube 220 is connected to a first gas supply source (not shown).

Figure 5:
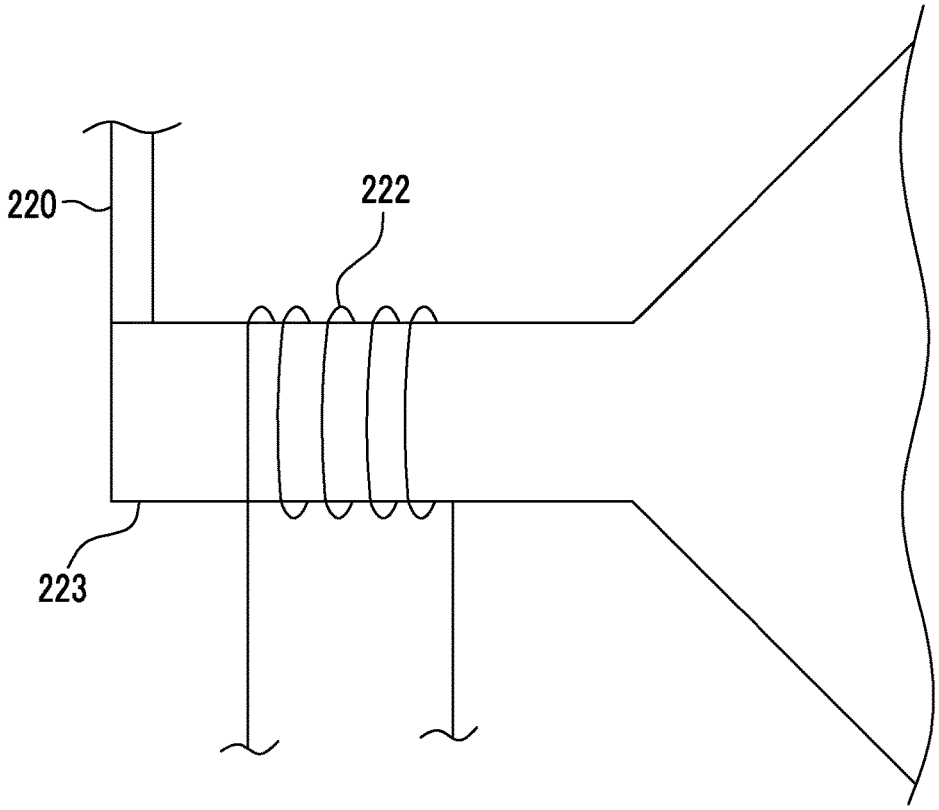
FIG. 5 is a schematic view showing an example of a plasma generation apparatus used for forming an inorganic protection layer of the electrophotographic photoreceptor of the exemplary embodiment.

A plasma generation apparatus shown in FIG. 5 may be used instead of the plasma generation apparatus provided in the film forming apparatus shown in FIGS. 4A and 4B. FIG. 5 is a schematic view showing another example of a plasma generation apparatus used in the film forming apparatus shown in FIGS. 4A and 4B and is a side view of the plasma generation apparatus. In FIG. 5, a reference numeral 222 indicates a high frequency coil, a reference numeral 223 indicates a quartz tube, and a reference numeral 220 indicates the same element shown in FIGS. 4A and 4B. This plasma generation apparatus is configured with the quartz tube 223 and the high frequency coil 222 provided along an outer peripheral surface of the quartz tube 223, and one end of the quartz tube 223 is connected to the film forming chamber 210 (not shown in FIG. 5). The gas introduction tube 220 for introducing gas into the quartz tube 223 is connected to another end of the quartz tube 223.

In FIGS. 4A and 4B, a rod-shaped shower nozzle 216 extending along the discharge surface is connected to the discharge surface side of the flat electrode 219, one end of the shower nozzle 216 is connected to the gas introduction tube 215, and the gas introduction tube 215 is connected to a second gas supply source (not shown) provided outside of the film forming chamber 210.

The base rotation unit 212 is provided in the film forming chamber 210 and the cylindrical base 214 is attached to the base rotation unit 212 through the base support member 213 so that a longitudinal direction of the shower nozzle 216 and an axial direction of the base 214 oppose each other. When forming a film, the base 214 rotates a circumferential direction by rotating the base rotation unit 212. As the base 214, a photoreceptor in which an organic photosensitive layer is laminated in advance, is used, for example.

The formation of the inorganic surface layer is performed as follows, for example.

First, oxygen gas (or helium (He) and diluted oxygen gas), helium (He) gas, and if necessary, hydrogen ($H_2$) gas are introduced into the high frequency discharge tube unit 221 from the gas introduction tube 220 and a radio wave at 13.56 MHz is supplied to the flat electrode 219 from the high frequency power supply unit 218. At that time, the plasma diffusion unit 217 is formed so as to be radially widened from the discharge surface side of the flat electrode 219 to the exhaust port 211 side. Herein, the gas introduced from the gas introduction tube 220 flows through the film forming chamber 210 from the flat electrode 219 side to the exhaust port 211 side. The vicinity of the flat electrode 219 may be surrounded by a ground shield.

Next, trimethylgallium gas is introduced to the film forming chamber 210 through the gas introduction tube 215 and the shower nozzle 216 positioning on a downstream side of the flat electrode 219 which is an activation unit, and accordingly, a non-single crystal film containing gallium, an oxygen atom, and a hydrogen atom is formed on the surface of the base 214.

A base in which the organic photosensitive layer is formed, is used, for example, as the base 214.

Since an organic photoreceptor including an organic photosensitive layer is used, a temperature of the surface of the base 214 when forming the inorganic surface layer is preferably equal to or lower than 150° C., and more preferably equal to or lower than 100° C., and particularly preferably from 30° C. to 100° C.

Even when the temperature of the surface of the base 214 is equal to or lower than 150° C. at the time of starting forming a film, the organic photosensitive layer may be damaged due to heat, in a case where the temperature becomes higher than 150° C. due to plasma effect, and accordingly, it is preferable to control the temperature of the surface of the base 214 by considering the effect.

The temperature of the surface of the base 214 may be controlled by a heating unit and cooling unit (not shown in the drawing) or may be naturally increased at the time of discharging. In a case of heating the base 214, a heater may be installed on the outer side or inner side of the base 214. In a case of cooling the base 214, gas or liquid for cooling may be circulated in the base 214.

It is effective to adjust high energy gas flow with respect to the surface of the base 214, in a case of avoiding an increase in a temperature of the surface of the base 214 due to discharge. In this case, the conditions of a gas flow rate or discharge output, and pressure are adjusted so as to achieve a necessary temperature.

An organic metal compound containing aluminum or a hydride such as diborane may be used instead of trimethylgallium gas and two or more kinds of these may be mixed with each other.

For example, in an initial stage of the formation of the inorganic surface layer, trimethylindium is introduced into the film forming chamber 210 through the gas introduction tube 215 and the shower nozzle 216, and accordingly, when a film containing nitrogen and indium is formed on the base 214, this film absorbs an ultraviolet ray which is generated in a case of continuously forming a film and deteriorates the organic photosensitive layer. Therefore, a damage on the organic photosensitive layer due to the generation of the ultraviolet ray at the time of forming a film is prevented.

As a method of doping a dopant at the time of forming a film, $SiH_3$ or $SnH_4$ is used for n type and biscyclopentadienylmagnesium, dimethyl calcium, or dimethyl strontium is used in a gaseous state for p type. When doping a dopant element in a surface layer, a well-known method such as a thermal diffusion method or an ion implantation method maybe used.

Specifically, gas containing at least one or more dopant elements is introduced into the film forming chamber 210 through the gas introduction tube 215 and the shower nozzle 216, and accordingly, n-type or p-type conductive inorganic surface layer is obtained.

In the film forming apparatus described with reference to FIGS. 4A to 5, active nitrogen or active hydrogen formed by discharge energy may be independently controlled by providing plural activation apparatuses, or gas containing nitrogen atoms or hydrogen atoms at the same time such as $NH_3$ may be used. $H_2$ may be further added thereto. In addition, conditions for isolatedly generating active hydrogen from the organic metal compound may be used.

By doing so, activated carbon atoms, gallium atoms, nitrogen atoms, or hydrogen atoms are present on the surface of the base 214 in a controlled state. The activated hydrogen atoms have an effect of separating hydrogen of a hydrocarbon group, such as a methyl group or an ethyl group, constituting the organic metal compound as a molecule.

Therefore, a hard film (inorganic surface layer) constituting three-dimensional bonds is formed.

A plasma generation unit of the film forming apparatus shown in FIGS. 4A to 5 uses a high frequency oscillation device, but there is no limitation, and a microwave oscillation device may be used or an Electron Cyclotron Resonance type or a helicon plasma type device may be used, for example. In a case of a high frequency oscillation device, the device may be an induction type or a capacitance type.

These devices may be used in combination of two or more kinds or two or more of the same devices may be used. A high frequency oscillation device is preferable in order to prevent an increase in a temperature of the surface of the base 214 due to plasma irradiation, but a device which prevents irradiation of heat may be provided.

In a case of using different two or more kinds of plasma generation apparatuses (plasma generation units), it is preferable that the discharge occurs at the same pressure at the same time. There may be a difference in pressure between a region to be discharged and a region where a film is formed (portion where the base is installed). These apparatuses may be disposed in serial with respect to the gas flow formed from a portion where gas is introduced into the film forming apparatus to a portion from which the gas is discharged, or may be disposed so that both apparatuses face a film forming surface of the base.

For example, in a case where two kinds of plasma generation units are installed in series with respect to a gas flow, a second plasma generation apparatus which causes discharge in the film forming chamber 210 using the shower nozzle 216 as an electrode is used, in an example of the film forming apparatus shown in FIGS. 4A and 4B. In this case, for example, a high frequency voltage is applied to the shower nozzle 216 through the gas introduction tube 215 and discharge is caused in the film forming chamber 210 using the shower nozzle 216 as an electrode. Alternatively, instead of using the shower nozzle 216 as an electrode, a cylindrical electrode is provided between the base 214 in the film forming chamber 210 and the flat electrode 219 and the discharge in the film forming chamber 210 is caused using this cylindrical electrode.

In a case of using the different two kinds of plasma generation apparatuses under the same pressure, for example, in a case of using a microwave oscillation device and a high frequency oscillation device are used, it is possible to significantly change excitation energy of excited species and it is effective to control film quality. The discharge may occur approximately under the pressure of the atmosphere (70,000 Pa to 110,000 Pa). In a case of causing the discharge approximately under the pressure of the atmosphere, it is preferable to use He as carrier gas.

In the formation of the inorganic surface layer, the base 214 in which the organic photosensitive layer is formed on a base is installed in the film forming chamber 210, for example, mixed gas having different compositions is introduced to form the inorganic surface layer.

In a case of causing the discharge by high frequency discharge, for example, under the film forming conditions, it is preferable to set a frequency in a range of 10 kHz to 50 MHz, in order to perform excellent film forming at a low temperature. The output depends on a size of the base 214, but the output is preferably in a range of 0.01 $W/cm^2$ to 0.2 $W/cm^2$ with respect to a surface area of the base. A rotation rate of the base 214 is preferably in a range of 0.1 rpm to 500 rpm.

Hereinabove, an example in which the photosensitive layer is a function separation type and the charge transport layer is a single-layer type has been described as the electrophotographic photoreceptor, but in a case of the electrophotographic photoreceptor shown in FIG. 2 (example in which the photosensitive layer is a function separation type and the charge transport layer is a multi-layer type), the charge transport layer 3A adjacent to the inorganic surface layer 5 has the same configuration as that of the charge transport layer 3 of the electrophotographic photoreceptor shown in FIG. 1, whereas the charge transport layer 3B which is not adjacent to the inorganic surface layer 5 may have the same configuration as that of a well-known charge transport layer.

Herein, a thickness of the charge transport layer 3A may be from 1 μm to 15 μm. A thickness of the charge transport layer 3B may be from 15 μm to 29 μm.

Meanwhile, in a case of the electrophotographic photoreceptor shown in FIG. 3 (example in which the photosensitive layer is a single layer type), the single-layer type photosensitive layer 6 (charge generation/charge transport layer) may have the same configuration as that of the charge transport layer 3 of the electrophotographic photoreceptor, except for containing the charge generation material.

Herein, the content of the charge generation material in the single-layer type organic photosensitive layer 6 may be from 25% by weight to 50% by weight with respect to the entire single-layer type photosensitive layer.

A thickness of the single-layer type photosensitive layer 6 may be from 15 μm to 30 μm.

Image Forming Apparatus (and Process Cartridge)

An image forming apparatus according to the exemplary embodiment includes an electrophotographic photoreceptor, a charging unit that charges a surface of the electrophotographic photoreceptor, an electrostatic latent image forming unit that forms an electrostatic latent image on a charged surface of the electrophotographic photoreceptor, a developing unit that develops the electrostatic latent image formed on the surface of the electrophotographic photoreceptor by a developer containing a toner to form a toner image, and a transfer unit that transfers the toner image onto the surface of a recording medium. The electrophotographic photoreceptor according to the exemplary embodiment is used as an electrophotographic photoreceptor.

As the image forming apparatus according to the exemplary embodiment, a known image forming apparatus is applied, such as an apparatus that includes a fixing unit which fixes a toner image transferred to a surface of a recording medium; a direct transfer-type apparatus that directly transfers a toner image formed on a surface of an electrophotographic photoreceptor to a recording medium; an intermediate transfer-type apparatus that primarily transfers a toner image formed on a surface of an electrophotographic photoreceptor to a surface of an intermediate transfer member, and secondarily transfers the toner image transferred to the surface of the intermediate transfer member to a surface of a recording medium; an apparatus that is provided with a cleaning unit that cleans a surface of an electrophotographic photoreceptor after transfer of a toner image and before charging; an apparatus that is provided with an erasing unit that performs erasing by irradiating the surface of the electrophotographic photoreceptor with erasing light after transfer of a toner image and before charging;

or an apparatus that includes an electrophotographic photoreceptor heating member for increasing a temperature of an electrophotographic photoreceptor and decreasing a relative temperature.

In a case of the intermediate transfer-type apparatus, a transfer unit includes, for example, an intermediate transfer member having a surface onto which a toner image is to be transferred, a primary transfer unit that primarily transfers a toner image formed on a surface of an electrophotographic photoreceptor onto the surface of the intermediate transfer member, and a secondary transfer unit that secondarily transfers the toner image transferred onto the surface of the intermediate transfer member onto a surface of a recording medium.

The image forming apparatus according to the exemplary embodiment may be either one of a dry developing type image forming apparatus and a wet developing type (developing type using a liquid developer) image forming apparatus.

In the image forming apparatus according to the exemplary embodiment, for example, a part including the electrophotographic photoreceptor may have a cartridge structure (process cartridge) that is detachable from the image forming apparatus. As the process cartridge, for example, a process cartridge including the electrophotographic photoreceptor according to the exemplary embodiment is preferably used. The process cartridge, for example, may include at least one selected from a group consisting of a charging unit, an electrostatic latent image forming unit, a developing unit, and a transfer unit, in addition to the electrophotographic photoreceptor.

Hereinafter, an example of the image forming apparatus according to the exemplary embodiment will be shown. However, this image forming apparatus is not limited thereto. Major parts shown in the drawing will be described, but descriptions of other parts will be omitted.

Figure 6:
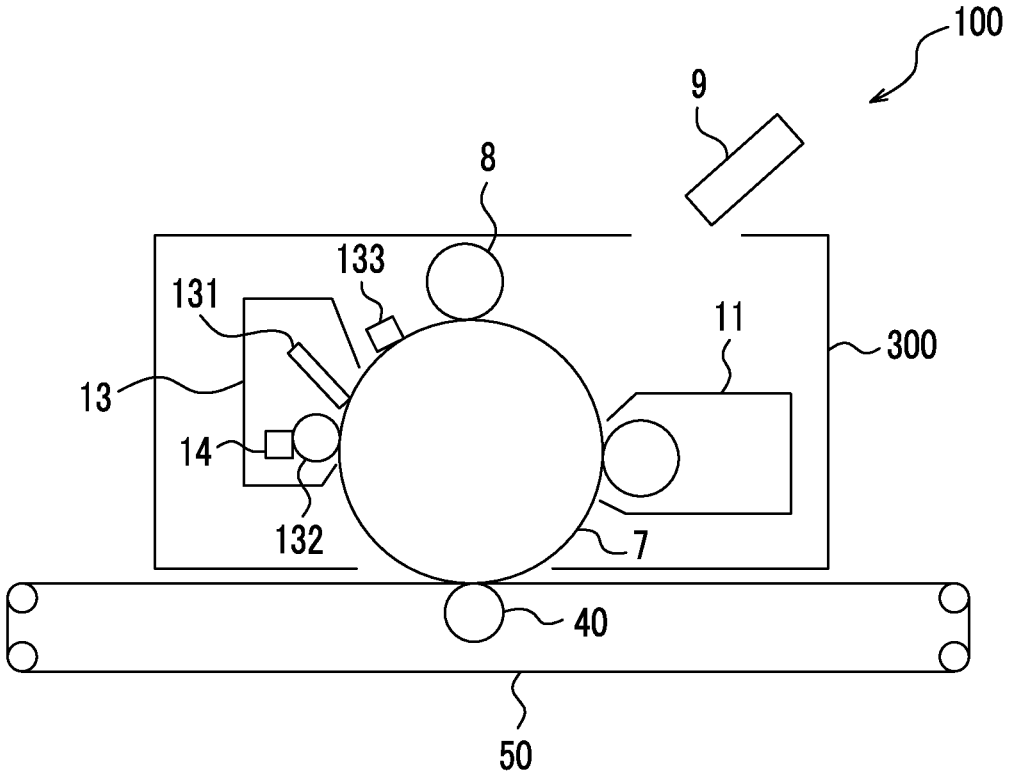
FIG. 6 is a schematic configuration view showing an example of an image forming apparatus according to the exemplary embodiment.

FIG. 6 is a schematic configuration view showing an example of the image forming apparatus according to the exemplary embodiment.

As shown in FIG. 6, an image forming apparatus 100 according to the exemplary embodiment includes a process cartridge 300 including an electrophotographic photoreceptor 7, an exposure device 9 (an example of the electrostatic latent image forming unit), a transfer device 40 (primary transfer unit), and an intermediate transfer member 50. In the image forming apparatus 100, the exposure device 9 is disposed in a position to expose light to the electrophotographic photoreceptor 7 from an opening of the process cartridge 300, the transfer device 40 is disposed in a position opposing the electrophotographic photoreceptor 7 with the intermediate transfer member 50 interposed therebetween, and the intermediate transfer member 50 is disposed so that a part thereof comes into contact with the electrophotographic photoreceptor 7. Although not shown, the image forming apparatus further includes a secondary transfer device that transfers a toner image transferred to the intermediate transfer member 50 to a recording medium (for example, paper). The intermediate transfer member 50, the transfer device 40 (primary transfer unit), and the secondary transfer device (not shown) correspond to an example of the transfer unit.

The process cartridge 300 shown in FIG. 6 integrally supports the electrophotographic photoreceptor 7, a charging device 8 (an example of the charging unit), a developing device 11 (an example of the developing unit), and a cleaning device 13 (an example of the cleaning unit) in a housing. The cleaning device 13 includes a cleaning blade (an example of the cleaning member) 131, and the cleaning blade 131 is disposed to come into contact with the surface of the electrophotographic photoreceptor 7. In addition, the cleaning member may not have the shape of the cleaning blade 131, but may be a conductive or insulating fiber-shaped member or this may be used alone or in combination with the cleaning blade 131.

In FIG. 6, as the image forming apparatus, an example of including a fiber type member 132 (having a roll shape) that supplies a lubricant 14 to the surface of the electrophotographic photoreceptor 7 and a fiber type member 133 (having a flat brush shape) which assists in cleaning is shown, but these are disposed as necessary.

Hereinafter, each configuration of the image forming apparatus according to the exemplary embodiment will be described.

Charging Device

As the charging device 8, a contact-type charger using a conductive or semiconductive charge roller, a charge brush, a charge film, a charge rubber blade, and a charge tube is used, for example. In addition, a well-known charger such as a non-contact-type roller charger, a scorotron charger using corona discharge, or a scorotron charger is also used.

Exposure Device

Examples of the exposure device 9 include optical devices that expose the surface of the electrophotographic photoreceptor 7 to a predetermined image form, with light such as semiconductor laser light, LED light, or liquid crystal shutter light. A wavelength of the light source is in the spectral sensitivity range of the electrophotographic photoreceptor. The mainstream of the wavelength of the semiconductor laser is near infrared that has an oscillation wavelength near 780 nm. However, the wavelength is not limited to this. For example, lasers having oscillation wavelengths on the order of 600 nm and lasers having oscillation wavelengths near the range of 400 nm to 450 nm may also be used as a blue laser. In order to forma color image, surface-emission laser light sources that output multibeams are also effective.

Developing Device

As the developing device 11, for example, a general developing device that performs development in a contact manner or a non-contact manner of the developer is used. The developing device 11 is not particularly limited as long as it has the above functions, and is selected in accordance with purposes. For example, a well-known developing device having a function of attaching a one-component developer or a two-component developer to the electrophotographic photoreceptor 7 using a brush or a roller is used. Among these, a developing device that uses a developing roller having a developer in a surface is preferably used.

The developer used in the developing device 11 may be a single-component developer including only the toner or a two-component developer obtained by mixing the toner with a carrier. The developer may be magnetic or non-magnetic. As these developers, well-known developers are used.

Cleaning Device

As the cleaning device 13, a cleaning blade-type device including the cleaning blade 131 is used.

In addition to a cleaning blade type, a fur brush cleaning or a developing and cleaning type may be used.

Transfer Device

As the transfer device 40, a well-known charger such as a contact-type charger using a belt, a roller, a film, or a rubber blade, a scorotron charger using corona discharge, or a corotron charger is used, for example.

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a belt-shaped intermediate transfer member (intermediate transfer belt) including polyimide, polyamide-imide, polycarbonate, polyarylate, polyester, or rubber, to which semiconductivity is applied, is used. The shape of the intermediate transfer member may be a drum shape or the like, in addition to the belt shape.

Figure 7:
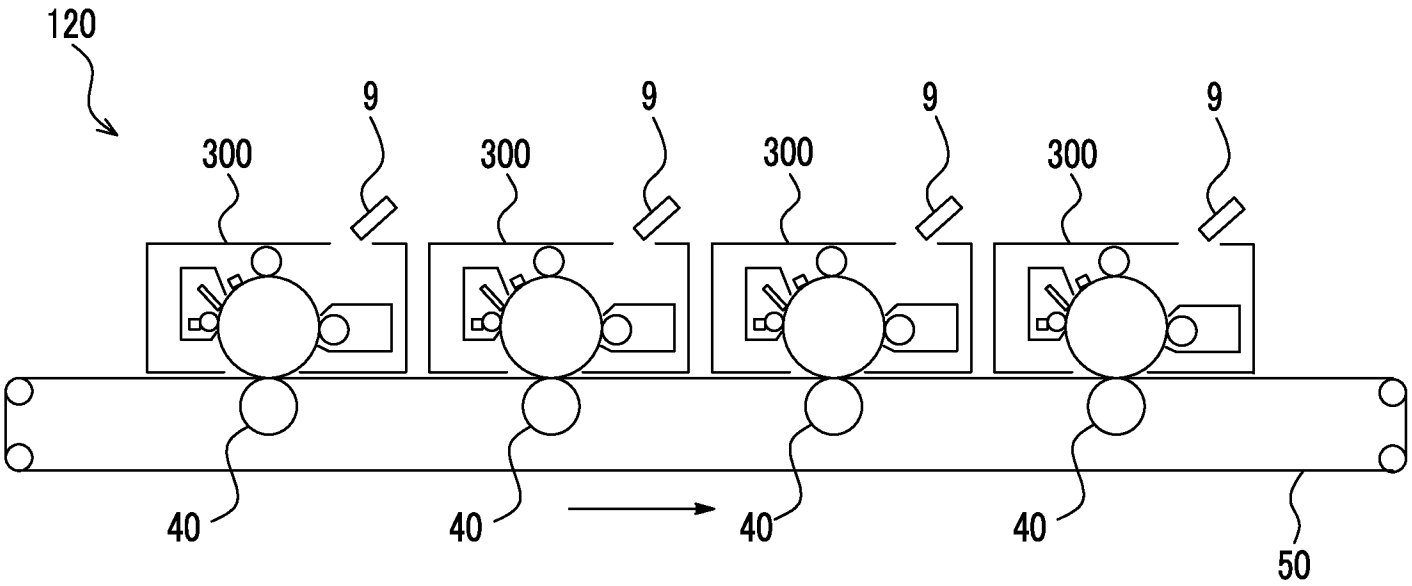
FIG. 7 is a schematic configuration view showing another example of the image forming apparatus according to the exemplary embodiment.

FIG. 7 is a schematic configuration view showing another example of an image forming apparatus according to the exemplary embodiment.

An image forming apparatus 120 shown in FIG. 7 is a tandem type multicolor image forming apparatus including four process cartridges 300 loaded thereon. In the image forming apparatus 120, the four process cartridges 300 are arranged in a line on the intermediate transfer member 50, and one electrophotographic photoreceptor is used for one color. The image forming apparatus 120 includes the same configuration as the image forming apparatus 100, except for being a tandem type.

EXAMPLES

Hereinafter, the invention will be described more specifically by the following examples, but the invention is not limited thereto.

Example 1

Preparation of Silica Particles (11)

30 parts by weight of trimethoxysilane ("product name: 1,1,1,3,3,3-hexamethyldisilazane (manufactured by Tokyo Chemical Industry Co., Ltd.)) as a hydrophobizing agent is added to 100 parts by weight of untreated (hydrophilic) silica particles "product name OX50 (manufactured by Nippon Aerosil co. ltd.)", a reaction is performed for 24 hours, filtration is performed, and thus, silica particles treated with a hydrophobizing agent are obtained. These are designated as silica particles (11).

Formation of Undercoating Layer 100 parts by weight of zinc oxide oxide (manufactured by TAYCA Corporation, average particle diameter of 70 nm and specific surface area of 15 $m^2/g$) is stirred and mixed with 500 parts by weight of tetrahydrofuran and 1.3 parts by weight of a silane coupling agent (KBM503 manufactured by Shin-Etsu Chemical Co., Ltd.) is added thereto and stirred for 2 hours. Then, tetrahydrofuran is distilled by vacuum distillation, and baking is performed at 120° C. for 3 hours to obtain a silane coupling agent surface treated-zinc oxide.

110 parts by weight of zinc oxide subjected to surface treatment and 500 parts by weight of tetrahydrofuran are stirred and mixed, and a solution obtained by dissolving 0.6 parts by weight of alizarin in 50 parts by weight of tetrahydrofuran is added thereto and stirred at 50° C. for 5 hours. Then, filtration is performed under reduced pressure and thus zinc oxide having alizarin applied thereto is separated. Drying is performed at 60° C. under reduced pressure, and thus, alizarin-applied zinc oxide is obtained.

38 parts by weight of a solution obtained by dissolving 60 parts by weight of the alizarin-added zinc oxide, 13.5 parts by weight of curing agent (blocked isocyanate, Sumidur 3175 manufactured by Sumitomo Bayer Urethane Co., Ltd.), 15 parts by weight of a butyral resin (S-LEC BM-1 manufactured by SEKISUI CHEMICAL CO., LTD.) in 85 parts by weight of methyl ethyl ketone, and 25 parts by weight of methyl ethyl ketone are mixed with each other, and dispersed for 2 hours by a sand mill using a glass bead having a diameter of 1 mmϕ, to obtain a dispersion.

0.005 parts by weight of dioctyl tin dilaurate as a catalyst and 40 parts by weight of silicone resin particles (Tospearl 145 manufactured by Momentive Performance Materials Inc.) are added to the obtained dispersion and thus, an undercoating layer coating solution is obtained. The undercoating layer coating solution is applied onto an aluminum base having a diameter of 60 mm, a length of 357 mm, and a thickness of 1 mm by a dip coating method, and drying and curing is performed at 170° C. for 40 minutes, to obtain an undercoating layer having a thickness of 19 μm.

Preparation of Charge Generation Layer

A mixture formed of 15 parts by weight of hydroxy gallium phthalocyanine as a charge generation material in which Bragg angles (20±0.2) of X-ray diffraction spectrum using CuKα characteristics have diffraction peaks at least at positions of 7.3°, 16.0°, 24.9°, and 28.0°, 10 parts by weight of a vinyl chloride-vinyl acetate copolymer resin as a binder resin (VMCH manufactured by Nippon Unicar Company Limited), and 200 parts by weight of n-butyl acetate, is dispersed for four hours by a sand mill using a glass bead having a diameter of 1 mmϕ. 175 parts by weight of n-butyl acetate and 180 parts by weight of methyl ethyl ketone are added to the obtained dispersion and stirred to obtain the charge generation layer coating solution. The charge generation layer coating solution is subjected to dip coating on the undercoating layer and dried at room temperature (25° C.) to form a charge generation layer having a film thickness of 0.2 μm.

Formation of Charge Transport Layer 95 parts by weight of tetrahydrofuran is put into 20 parts by weight of the silica particles (11) and 10 parts by weight of N,N'-diphenyl-N,N'-bis(3-methylphenyl)-(1,1'-diphenyl)-4,4'-diamine and 10 parts by weight of the following biphenyl copolymerization type polycarbonate resin as a binder resin are added thereto and stirred and mixed for 12 hours while maintaining the temperature at 20° C., to obtain a charge transport layer forming coating solution. The content thereof in a solid content of the silica particles is 50% by weight.

A biphenyl copolymerization type polycarbonate resin formed by copolymerizing structural units represented by (PC-1) at a copolymerization ratio (pm:pn ratio) of 25:75 (viscosity-average molecular weight of 50,000)

The charge transport layer forming coating solution is applied onto the charge generation layer and dried at 135° C. for 40 minutes, and a charge transport layer having a film thickness of 30 μm is formed. Through the above processes, a non-coated photoreceptor (1) in which the undercoating layer, the charge generation layer, and the charge transport layer are laminated on the aluminum base in this order is obtained.

Formation of Inorganic Surface Layer

Next, an inorganic surface layer configured with gallium oxide containing hydrogen is formed on the surface of the non-coated photoreceptor (1). The formation of the inorganic surface layer is performed using a film forming apparatus having the configuration shown in FIGS. 4A and 4B.

First, the non-coated photoreceptor (1) is loaded on the base support member 213 in the film forming chamber 210 of the film forming apparatus and the film forming chamber 210 is evacuated through the exhaust port 211 so that the pressure becomes 0.1 Pa. Next, He diluted 40% oxygen gas (flow rate of 1.6 sccm) and hydrogen gas (flow rate of 50 sccm) are introduced into the high frequency discharge tube unit 221 provided with the flat electrode 219 having a diameter of 85 mm from the gas introduction tube 220, the radiowave at 13.56 MHz is set at the output of 150 W by the high frequency power supply unit 218 and a matching circuit (not shown in FIGS. 4A and 4B) and subjected to matching with a tuner, and the discharge is performed from the flat electrode 219. A reflected wave at this time is 0 W.

Then, trimethylgallium gas (flow rate of 1.9 sccm) is introduced to the plasma diffusion unit 217 in the film forming chamber 210 from the shower nozzle 216 through the gas introduction tube 215. At that time, reaction pressure in the film forming chamber 210 measured using a Baratron vacuum gage is 5.3 Pa.

In this state, a film is formed for 68 minutes while rotating the non-coated photoreceptor (1) at a rate of 500 rpm and an inorganic surface layer having a film thickness of 0.25 μm is formed on the surface of the charge transport layer of the non-coated photoreceptor (1).

The electrophotographic photoreceptor in which the undercoating layer, the charge generation layer, the charge transport layer, and the inorganic surface layer are formed on the electroconductive substrate in this order is obtained through the processes described above. Measurement results obtained by the method of measuring charpy impact strength of the charge transport layer are shown in Table 1.

Example 2

An electrophotographic photoreceptor is obtained by the method described in Example 1, except for changing the binder resin used in the preparation of the charge transport layer in Example 1 to the following biphenyl copolymerization type polycarbonate resin.

A biphenyl copolymerization type polycarbonate resin formed by copolymerizing structural units represented by the formula (PC-1) at a copolymerization ratio (pm:pn ratio) of 25:75 (viscosity-average molecular weight of 30,000)

Comparative Example 1

An electrophotographic photoreceptor is obtained by the method described in Example 1, except for changing the binder resin used in the preparation of the charge transport layer in Example 1 to the following polycarbonate resin.

A polycarbonate resin formed by polymerizing structural units represented by the formula (PC-1) at a copolymerization ratio (pm:pn ratio) of 0:100 (that is, including only structural units represented by the formula (PCB)) (viscosity-average molecular weight of 50,000)

Comparative Example 2

An electrophotographic photoreceptor is obtained by the method described in Example 1, except for changing the binder resin used in the preparation of the charge transport layer in Example 1 to the following polycarbonate resin.

A polycarbonate resin formed by copolymerizing structural units represented by the formula (PC-1) at a copolymerization ratio (pm:pn ratio) of 0:100 (that is, including only structural units represented by the formula (PCB)) (viscosity-average molecular weight of 20,000)

Comparative Example 3

An electrophotographic photoreceptor is obtained by the method described in Example 1, except for changing the binder resin used in the preparation of the charge transport layer in Example 1 to the following polycarbonate resin.

A biphenyl copolymerization type polycarbonate resin formed by polymerizing structural units represented by the formula (PC-1) at a copolymerization ratio (pm:pn ratio) of 5:95 (viscosity-average molecular weight of 20,000)

Evaluation

Image Blurring

The electrophotographic photoreceptor obtained in each example is attached to 700 Digital Color Press manufactured by Fuji Xerox Co., Ltd., the printing test is performed by continuously printing half-tone images (image density of 30%) at 100 kPV (=100,000 sheets) under a high temperature and high humidity environment (20° C. and 40% RH), and evaluation regarding image blurring is performed.

Evaluation Criteria

A: the same image is output after continuous printing, compared to the initial printed image B: image density is deteriorated after continuous printing, compared to the initial printed image Cracks on Inorganic Surface Layer and Charge Transport Layer After the image blurring test, the section of the inorganic surface layer and the charge transport layer is processed by FIB-SEM Helios NanoLab 600i manufactured by FEI and observation thereof is performed.

FIB Processing Conditions

Accelerating voltage: 30 [kV]

SEM Observation Conditions

Accelerating voltage: 1 [kV] and detector: TLD-BSE (reflection electron detection)

Evaluation Criteria

A: no cracks are formed on the inorganic surface layer and the charge transport layer B: cracks are formed on the inorganic surface layer and the charge transport layer

TABLE 1

| | Binder resin structure | Binder resin molecular weight | Charpy impact strength [kJ/m$^2$] | Evaluation | |
|---|---|---|---|---|---|
| | | | | Cracks | Image blurring |
| Example 1 | (PC-1) pm:pn = 25:75 | 50,000 | 16.4 | A | A |
| Example 2 | (PC-1) pm:pn = 25:75 | 30,000 | 12.3 | A | A |
| Comparative Example 1 | (PC-1) pm:pn = 0:100 | 50,000 | 10.5 | B | B |
| Comparative Example 2 | (PC-1) pm:pn = 0:100 | 20,000 | 3.1 | B | B |
| Comparative Example 3 | (PC-1) pm:pn = 5:95 | 20,000 | 5.0 | B | B |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

an electroconductive substrate;

a photosensitive layer provided on the electroconductive substrate; and an inorganic surface layer provided on the photosensitive layer, wherein a layer constituting an outermost surface of the photosensitive layer contains from 30% by weight to 70% by weight of silica particles and contains a biphenyl copolymerization type polycarbonate resin including a structural unit represented by the formula (PCA) and a structural unit represented by the formula (PCB) at a copolymerization ratio (PCA:PCB (molar ratio)) of 10:90 to 50:50:

(PCA)

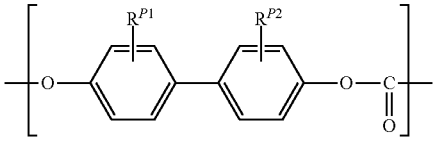

(PCB)

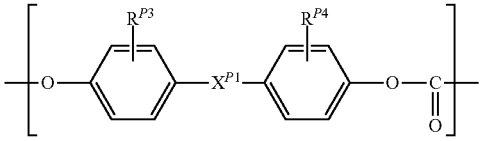

wherein $R^{P1}$, $R^{P2}$, $R^{P3}$, and $R^{P4}$ each independently represent a hydrogen atom, a halogen atom, an alkyl group having 1 to 6 carbon atoms, a cycloalkyl group having 5 to 7 carbon atoms, or an aryl group having 6 to 12 carbon atoms, and $X^{P1}$ represents a phenylene group, a biphenylene group, a naphthylene group, an alkylene group, or a cycloalkylene group, and wherein a charpy impact strength of the layer constituting the outermost surface of the photosensitive layer is from 12 kJ/m$^2$ to 35 kJ/m$^2$.

2. The electrophotographic photoreceptor according to claim 1, wherein the structural unit represented by the formula (PCA) and the structural unit represented by the formula (PCB) are a structural unit represented by the formula (PCA-1) and a structural unit represented by the formula (PCB-1), respectively:

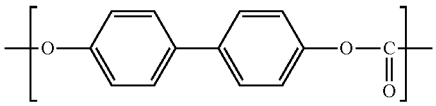

(PCA-1)

-continued

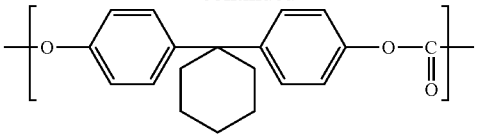

(PCB-1)

3. The electrophotographic photoreceptor according to claim 2, wherein the inorganic surface layer contains an element in Group 13, an oxygen atom, and a hydrogen atom, provided that a sum of an element composition ratio of the element in Group 13, an oxygen atom, and a hydrogen atom with respect to the entirety of elements constituting the inorganic surface layer is equal to or greater than 90 atom %, and an atomic ratio of element composition of an oxygen atom and the element in Group 13 (oxygen/element in Group 13) is from 1.1 to 1.5.

4. The electrophotographic photoreceptor according to claim 1, wherein the inorganic surface layer contains an element in Group 13, an oxygen atom, and a hydrogen atom, provided that a sum of an element composition ratio of the element in Group 13, an oxygen atom, and a hydrogen atom with respect to the entirety of elements constituting the inorganic surface layer is equal to or greater than 90 atom %, and an atomic ratio of element composition of an oxygen atom and the element in Group 13 (oxygen atom/element in Group 13) is from 1.1 to 1.5.

5. A process cartridge that is detachable from an image forming apparatus, the cartridge comprising:

the electrophotographic photoreceptor according to claim 1.

6. An image forming apparatus comprising:

the electrophotographic photoreceptor according to claim 1;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor by a developer containing a toner to form a toner image; and a transfer unit that transfers the toner image onto a surface of a recording medium.

* * * * *